US005408247A

United States Patent [19]

Enomoto et al.

[11] Patent Number: 5,408,247

[45] Date of Patent: Apr. 18, 1995

[54] INFORMATION PROCESSING APPARATUS AND DISPLAY SYSTEM WITH SIMULTANEOUS PARTIAL REWRITING SCANNING CAPABILITY

[75] Inventors: Aiko Enomoto, Zama; Hiroshi Inoue, Yokohama; Shuntato Aratani, Tokyo, all of Japan

[73] Assignee: Canon Kabushiki Kaisha, Tokyo, Japan

[21] Appl. No.: 41,331

[22] Filed: Apr. 1, 1993

Related U.S. Application Data

[63] Continuation of Ser. No. 553,640, Jul. 17, 1990, abandoned.

[30] Foreign Application Priority Data

Dec. 19, 1989 [JP] Japan ..... 1-330384

[51] Int. Cl.[6] ..... G09G 3/36

[52] U.S. Cl. ..... 345/100; 345/98

[58] Field of Search ..... 340/784, 706; 345/97, 345/98, 100, 123, 125

[56] References Cited

U.S. PATENT DOCUMENTS

| | | | |
|---|---|---|---|
| 4,655,561 | 4/1987 | Kanbe et al. | 350/350 S |
| 4,691,200 | 9/1987 | Stephany | 340/784 |
| 4,693,563 | 9/1987 | Harada et al. | 340/784 |
| 4,710,762 | 12/1987 | Yamada | 340/721 |
| 5,091,723 | 2/1992 | Kanno et al. | 340/784 |

FOREIGN PATENT DOCUMENTS

| | | |
|---|---|---|
| 316774 | 5/1989 | European Pat. Off. . |
| 318050 | 5/1989 | European Pat. Off. . |
| 361471 | 4/1990 | European Pat. Off. . |
| 8906415 | 7/1989 | WIPO . |

*Primary Examiner*—Jeffery Brier

*Attorney, Agent, or Firm*—Fitzpatrick, Cella, Harper & Scinto

[57] ABSTRACT

An information processing apparatus uses an information memory for storing image information and first and second controllers for controlling the storage of image information associated with a generated graphics event into the memory based on a display request from a pointing device. In addition, image information for one frame of the display is stored into the image information memory by a first storer, and image information for a window display is stored into the image information memory by a second storer. An image transfer controller controls an image transfer from the image information memory such that when, during storing of the image information for one frame of the display, without the display request for the window display, the display request from the pointing device is generated, and the first controller controls the start of storage of image information when, during storing of the image information by the first storer, the display request of the window display and the display request from the pointing device are produced, the display request of the window display is met by the second storer for storing image information for the window display, and the display request from the pointing device is met by the second controller. A matrix electrode with scanning lines and information lines can also be provided, along with a driver for driving the matrix electrode.

8 Claims, 25 Drawing Sheets

| |
|---|
| FIG. 9C-1 |
| FIG. 9C-2 |

TO FIG. 9C-2

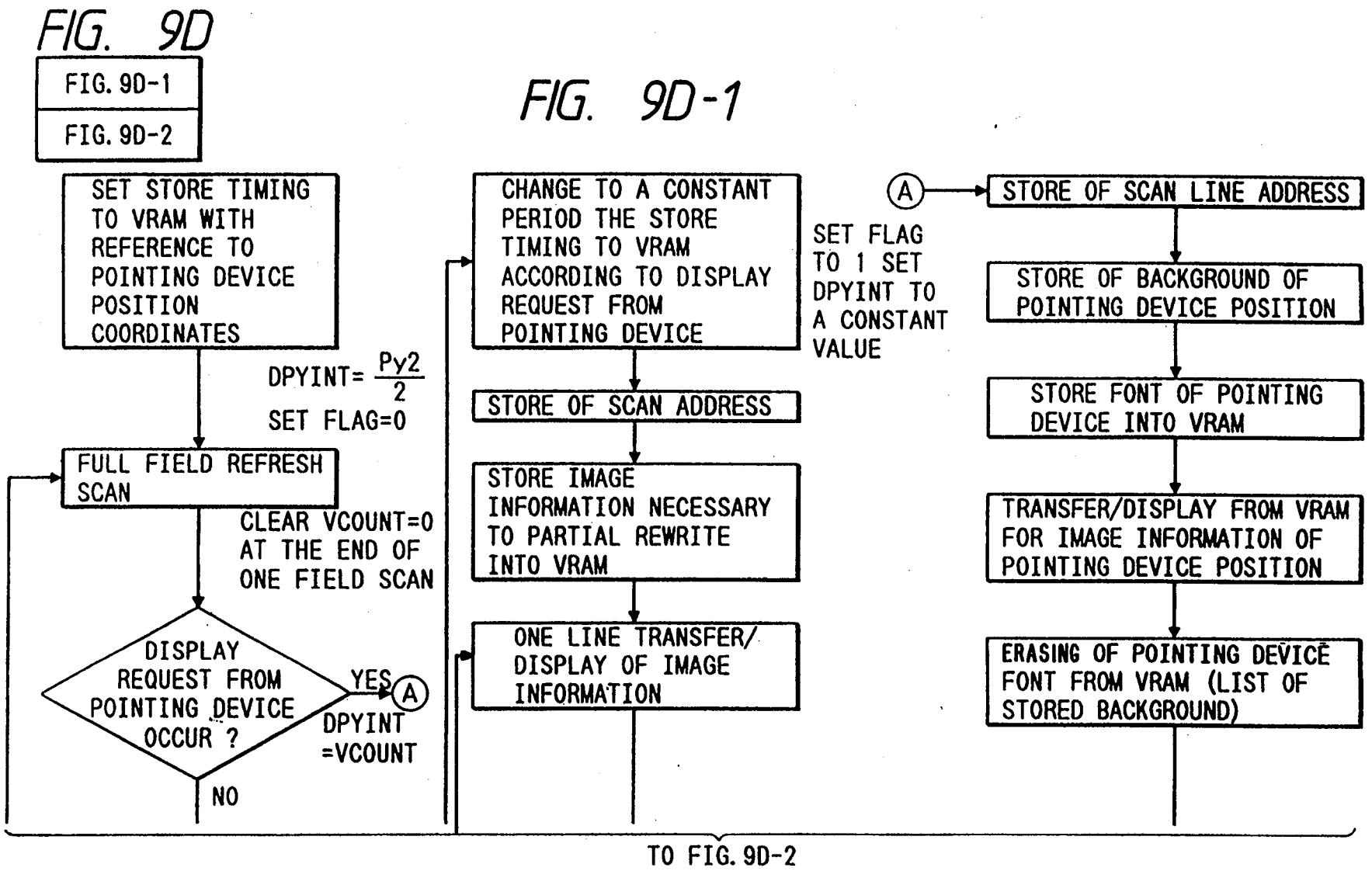
FIG. 9D
FIG. 9D-1
FIG. 9D-2
SET STORE TIMING TO VRAM WITH REFERENCE TO POINTING DEVICE POSITION COORDINATES
DPYINT= Py2/2
SET FLAG=0
FULL FIELD REFRESH SCAN
CLEAR VCOUNT=0 AT THE END OF ONE FIELD SCAN
DISPLAY REQUEST FROM POINTING DEVICE OCCUR ?
YES
A
DPYINT =VCOUNT
NO
CHANGE TO A CONSTANT PERIOD THE STORE TIMING TO VRAM ACCORDING TO DISPLAY REQUEST FROM POINTING DEVICE
STORE OF SCAN ADDRESS
STORE IMAGE INFORMATION NECESSARY TO PARTIAL REWRITE INTO VRAM
ONE LINE TRANSFER/ DISPLAY OF IMAGE INFORMATION
TO FIG. 9D-2
A
SET FLAG TO 1 SET DPYINT TO A CONSTANT VALUE
STORE OF SCAN LINE ADDRESS
STORE OF BACKGROUND OF POINTING DEVICE POSITION
STORE FONT OF POINTING DEVICE INTO VRAM
TRANSFER/DISPLAY FROM VRAM FOR IMAGE INFORMATION OF POINTING DEVICE POSITION
ERASING OF POINTING DEVICE FONT FROM VRAM (LIST OF STORED BACKGROUND)

FIG. 12A

| | | (4M-3) FIELD $F_{4M-3}$, (M = 1, 2, 3, ···) | (4M-2) FIELD $F_{4M-2}$, (M = 1, 2, 3, ···) | (4M-1) FIELD $F_{4M-1}$, (M = 1, 2, 3, ···) | 4M FIELD $F_{4M}$ (M = 1, 2, 3, ···) |
|---|---|---|---|---|---|
| SCAN SIGNAL | SCAN SELECTION SIGNAL APPLIED TO (4n-3)TH SCAN ELECTRODE $S_{4n-3}$ (n=1, 2, 3, ···) | $2V_0$ 0 $-2V_0$ | NO SCAN (SCAN NON-SELECTION SIGNAL) | $2V_0$ 0 $-2V_0$ | NO SCAN (SCAN NON-SELECTION SIGNAL) |
| | SCAN SELECTION SIGNAL APPLIED TO (4n-2)TH SCAN ELECTRODE $S_{4n-2}$ (n=1, 2, 3, ···) | NO SCAN (SCAN NON-SELECTION SIGNAL) | $2V_0$ 0 $-2V_0$ | NO SCAN (SCAN NON-SELECTION SIGNAL) | $2V_0$ 0 $-2V_0$ |
| | SCAN SELECTION SIGNAL APPLIED TO (4n-1)TH SCAN ELECTRODE $S_{4n-1}$ (n=1, 2, 3, ···) | $2V_0$ 0 $-2V_0$ | NO SCAN (SCAN NON-SELECTION SIGNAL) | $2V_0$ 0 $-2V_0$ | NO SCAN (SCAN NON-SELECTION SIGNAL) |
| | SCAN SELECTION SIGNAL APPLIED TO 4nTH SCAN ELECTRODE $S_{4n}$ (n=1, 2, 3, ···) | NO SCAN (SCAN NON-SELECTION SIGNAL) | $2V_0$ 0 $-2V_0$ | NO SCAN (SCAN NON-SELECTION SIGNAL) | $2V_0$ 0 $-2V_0$ |
| | SCAN NON-SELECTION SIGNAL | 0 | 0 | 0 | 0 |

| |
|---|
| FIG. 12B-1 |
| FIG. 12B-2 |

INFORMATION PROCESSING APPARATUS AND DISPLAY SYSTEM WITH SIMULTANEOUS PARTIAL REWRITING SCANNING CAPABILITY

This application is a continuation of 07/553,640 filed on Jul. 17, 1990, now abandoned.

BACKGROUND OF THE INVENTION

1. Field of the Invention

The present invention relates to an information processing apparatus and a display system, and more particularly to an information processing apparatus for a liquid crystal display system employing ferroelectric liquid crystal with memory ability.

2. Related Background Art

In the field of display for computer terminals, there are principally employed cathode ray tubes of refresh scan type, and cathode ray tubes of vector scan type are partly used in large-sized high-resolution displays for CAD applications. The vector-scan cathode ray tubes, in which the image, once displayed, is not erased until the image frame is renewed, are not suitable for real-time man-machine interface displays requiring cursor movement, moving display of a pointing device such as a mouse, displays of editing (insertion deletion, movement, copying) with icons, characters and text etc. On the other hand, the refresh-scan cathode ray tubes require refreshing cycles with a frame frequency at least equal to 60 Hz for preventing flicker phenomenon, and employ non-interlaced scanning system for improving the visibility of moving display of the information in the image frame. (As already well known, television employs interlaced scanning system with a field frequency of 60 Hz and a frame frequency of 30 Hz for simplifying the moving image display and the drive control system.) For this reason, as the resolving power of display becomes higher, there are inevitably required a larger display unit, a larger power consumption, a larger drive control device and a higher cost.

In fact the recent development of flat panel displays is based on the inconvenience of bulkiness and high power consumption of the cathode ray tubes.

Presently there are known several types in the flat panel display. For example the twisted nematic liquid crystal-display with high time-divided drive (STN), its black-and-white version (NTN), or the plasma display employs same image data transfer method as in the cathode ray tubes, and the non-interlaced scanning method with a frame frequency at least equal to 60 Hz. Since such displays do not have memory ability in principle, there is required refreshing cycles with a frame frequency at least equal to 60 Hz for preventing flickering, so that the horizontal scanning time is 10 to 50 μsec. or even shorter in case of a large display panel with 400 to 480 horizontal scanning lines constituting an image frame, and sufficiently high contrast cannot be obtained.

Ferroelectric liquid crystal display can provide a far larger panel size and a far higher resolution in comparison with the above-mentioned conventional displays, but, because of the low frame frequency, there is being required a partial rewriting scanning method (scanning only in the lines to be rewritten), exploiting the advantage of memory ability, in order to be applied to the man-machine interface displays as explained before. Such partial rewriting method is already disclosed for example by Kanbe et al. in the U.S. Pat. No. 4,655,561.

In the ferroelectric liquid crystal displays, the above-mentioned partial rewriting scanning method is suitable for the moving display for a mouse or a cursor, or for multi-window scroll display, but such partial rewriting scanning cannot be conducted in two areas at the same time. Consequently, in the partial rewriting scanning in an area designated by a start address and an end address, the moving display for mouse or cursor cannot be made in the course of multi-window scroll display. More specifically, for example in case of the window scroll display and the display for pointing device, if the pointing device is moved after the start of a partial rewriting scanning operation started in response to a request for window scroll display, the rewriting scanning operation for said pointing device cannot be started until the window scanning operation is completed to the last scanning line. Consequently the movement of the pointing device can only be displayed uncontinuously according to the size of window (number of rewriting scanning lines), so that the moving display becomes evidently unnatural.

SUMMARY OF THE INVENTION

An object of the present invention is to provide an information processing apparatus adapted for use in a ferroelectric liquid crystal display, for obtaining display with real-time operability suitable as a man-machine interface.

Another object of the present invention is to provide an information processing apparatus capable of providing smooth moving display for a mouse or the like.

The present invention is firstly featured by an information processing apparatus comprising:

a) an image information memory for storing image information;

b) first means for controlling the start of storage, into said memory, of image information associated with a generated graphic event, taking the coordinate of said graphic event as reference;

c) second means for effecting control in such a manner as to store the image information associated with the generated graphic event into said memory at a constant interval; and d) third means for switching the first and second means.

The present invention is secondly featured by a display system comprising:

a) matrix electrodes consisting of scanning lines and information lines;

b) drive means for driving said matrix electrodes;

c) drive control means for controlling said drive means; and d) graphics control means having an image information memory for storing image information, first control means for controlling the start of storage, into said memory, of image information associated with a generated graphic event, taking the positional coordinate of said graphic even as reference, and second control means for effecting control in such a manner as to store the image information associated with the generated graphic event into said memory at a constant interval, and adapted to control the designated first or second control means in response to the generation of a graphic event different from the above-mentioned graphic even in such a manner as to transfer the image information stored in said memory to the drive control means.

BRIEF DESCRIPTION OF THE DRAWINGS

FIGS. 9C, 9C-1 and 9C-2 are views showing the flow of display process in case of plural requests for partial rewriting scans in the conventional system;

FIGS. 9D, 9D-1 and 9D-2 are flow charts showing the algorithm of the system of the present invention;

FIGS. 9E, 9E-1 and 9E-2 are views showing the corresponding flow of display process;

FIGS. 12A, 12B, 12B-1 and 12B-2 are views showing drive signals employed in the present invention;

DESCRIPTION OF THE PREFERRED EMBODIMENTS

Figure 1:
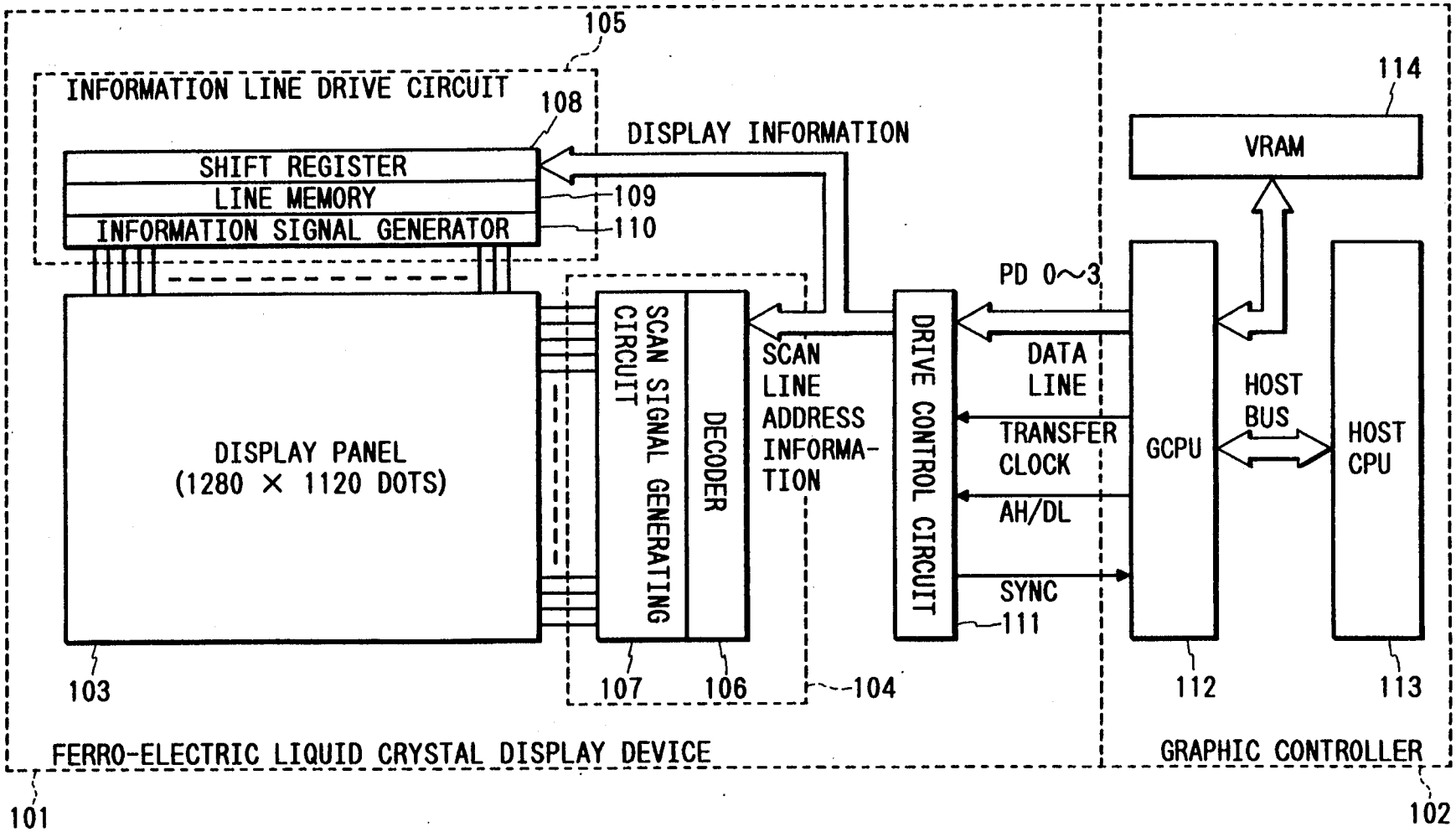
FIG. 1 is a block diagram of a liquid crystal display device and a graphics controller.
Figure 2:
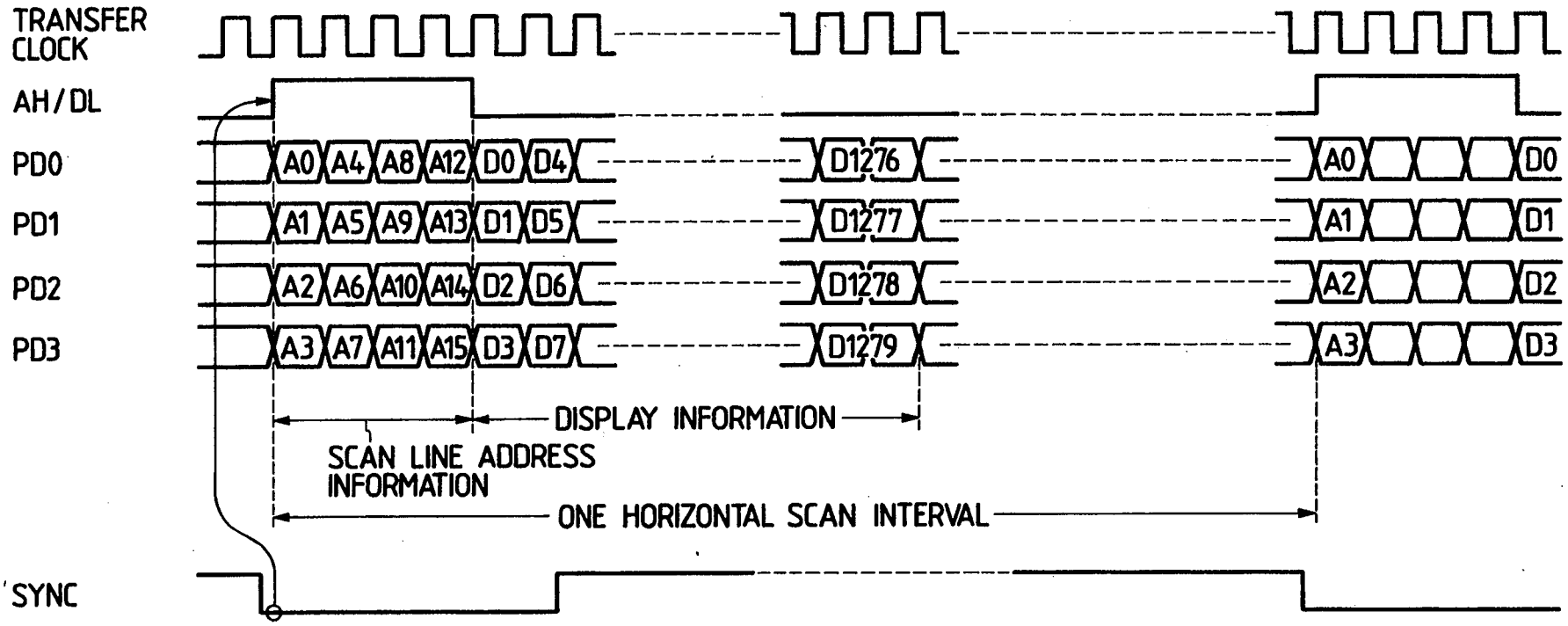
FIG. 2 is a timing chart of communication of image information between the liquid crystal display device and the graphics controller.

FIG. 1 is a block diagram of a ferroelectric liquid crystal display device 101 and a graphic controller 102 provided in a host equipment such as a personal computer serving as the supply source of display information, and FIG. 2 is a timing chart of the communication of image information. A display panel 103 is composed of two glass plates having 1120 scanning electrodes and 1280 information electrodes in a matrix arrangement and subjected to orienting treatment, and ferroelectric liquid crystal is sealed therebetween, and said scanning electrodes and information electrodes are respectively connected to a scanning line drive circuit 104 and an information line drive circuit 105.

In the following there will be explained the function with reference to the drawings. The graphics controller 102 sends scanning line address information for designating a scanning electrode and image information (PD0–PD3) on the scanning line designated by said address information, to display drive circuits 104/105 (composed of the scanning line drive circuit 104 and information line drive circuit 105) of the liquid crystal display device 101. In the present embodiment, the address information and the display information have to be distinguished mutually, since they are transmitted through a same transmission channel. For this purpose there is employed an AH/DL signal, which indicates the scanning line address information in the H-level or the display information in the L-level.

The scanning line address information is extracted, in a drive control circuit 111 of the liquid crystal display device 101, from the transmitted image information PD0–PD3, and is to activate the designated scanning electrode by a scan signal generating circuit 107, while the display information is guided to a shift register 108 in the information line drive circuit 105, and is shifted by a unit of 4 pixels by a transfer clock signal. When the shift of a horizontal scan line is completed by said shift register 108, the display information of 1280 pixels is transferred to a parallel line memory 109, stored thereby during a horizontal scanning peirod, and supplied as display information signals to respective information electrodes from an information signal generating circuit 110.

In the present embodiment, since the drive of the display panel 103 in the liquid crystal display device 101 is not synchronized with the generation of the scan line address information and the display information in the graphics controller 102, it is necessary to synchronize said units 101, 102 at the transfer of the image information. Said synchronization is achieved by a signal SYNC, generated by the drive control circuit 111 in the liquid crystal display device 101 at every horizontal scanning period. The graphic controller 102 always monitors the SYNC signal, and effects the transfer of image information when said SYNC signal is at the L-level, but does not effect the transfer after the transfer of image information of a horizontal scanning line in case of the H-level. Referring to FIG. 2, the graphics controller 102, upon detecting the shift of the SYNC signal to the L-level, shifts the AH/DL signal to the H-level thereby starting the transfer of the image information of a horizontal scanning line. The drive control circuit 111 of the liquid display device 101 shifts the SYNC signal to the H-level during the image information transfer period. After the writing into the display panel 103 subsequent to a horizontal scanning period, the drive control circuit (FLCD controller) 111 shifts the SYNC signal again to the L-level, thereby preparing for the reception of the image information of a next scanning line.

Figure 3:
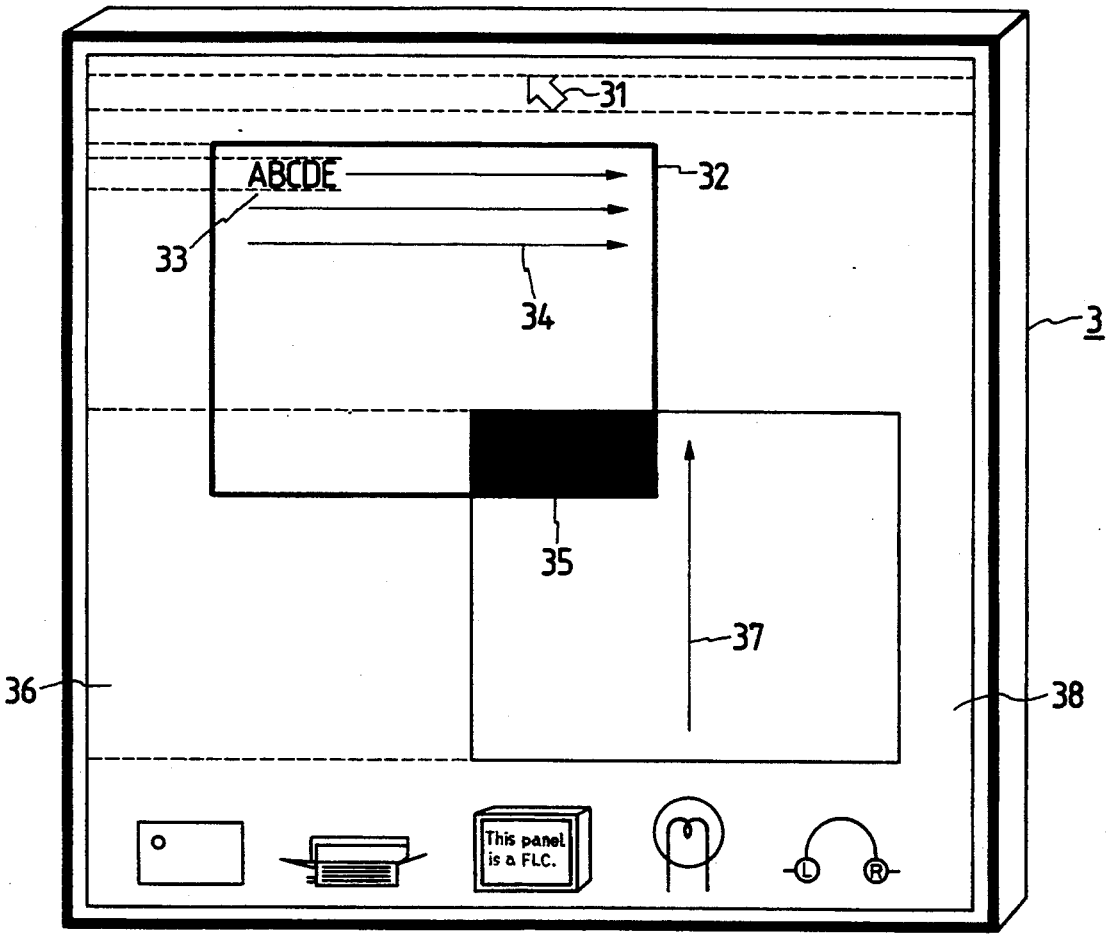
FIG. 3 is a view of a display frame schematically showing plural graphics events.

FIG. 3 shows a display frame 3 in case of plural requests for information display in a multi-task system with multiple windows, wherein:

- display request 31: smooth diagonal movement of mouse font;
- display request 32: a window is selected as an active frame, and the over-lapping area with an already displayed window is displayed over the entire frame;
- display request 33: insertion of characters by input from a keyboard;
- display request 34: movement of already displayed characters (in a direction indicated by arrow);
- display request 35: change of display of over-lapping area;
- display request 36: display of non-active window;
- display request 37: scroll display of non-active window;
- display request 38: scanning display over entire area.

Following Table 1 shows the priority of display of the graphic events corresponding to the above-mentioned display requests 31–38.

TAB. 1

| | Graphic event | Drive mode | Display priority | Display operation |
|---|---|---|---|---|
| 31 | Mouse moving display | partial rewrite | 1st level | |
| 32 | Active window area on | | | logical access area |
| 33 | Character insertion | partial rewrite | 2nd level | |
| 34 | Character movement | partial rewite | 3rd level | |
| 35 | Overlap area display change | | | logical VRAM operation |
| 36 | Non-active window area on | | | logical access area |
| 37 | Non-active window area scroll display | partial rewrite | 4th level | |
| 38 | Entire area scanning display | multi-field refresh | lowest level | |

In Tab. 1, "partial rewriting" means a drive method for scanning only the lines in the partially rewritten area. "Multi-field refresh" means a multi-interlaced scanning method for forming a frame with N fields (N=2, 4, 8, . . . ) as disclosed in the Japanese Patent Application Sho 62-287172. "Display priority" indicates a predetermined priority. In the present embodiment, giving emphasis on the scanning ability of man-machine interface, the highest priority is given to the graphic event 31 (moving display of mouse), and the graphic evens 33, 34, 37 and 38 are given priorities in the descending order. "Display operation" indicates the internal display operation of the graphic processor.

The highest priority is given to the moving display of the mouse, because the pointing device is used to reflect the intention of operator on real-time basis to the computer. Next importance is given to the character input from the keyboard. However such input is usually buffered, so that the requirement for real-time display is less than that of the mouse. The image frame renewal of the window in response to the key input need not necessarily be simultaneous with the key input, and the row under key input has the higher priority. The relationship between the scroll display in another window and the display in the overlapping area is variable according to the system designing, but such situation has to be anticipated in a multi-task display, and it is assumed in the present embodiment that the scroll display is conducted below the active window.

Figure 4:
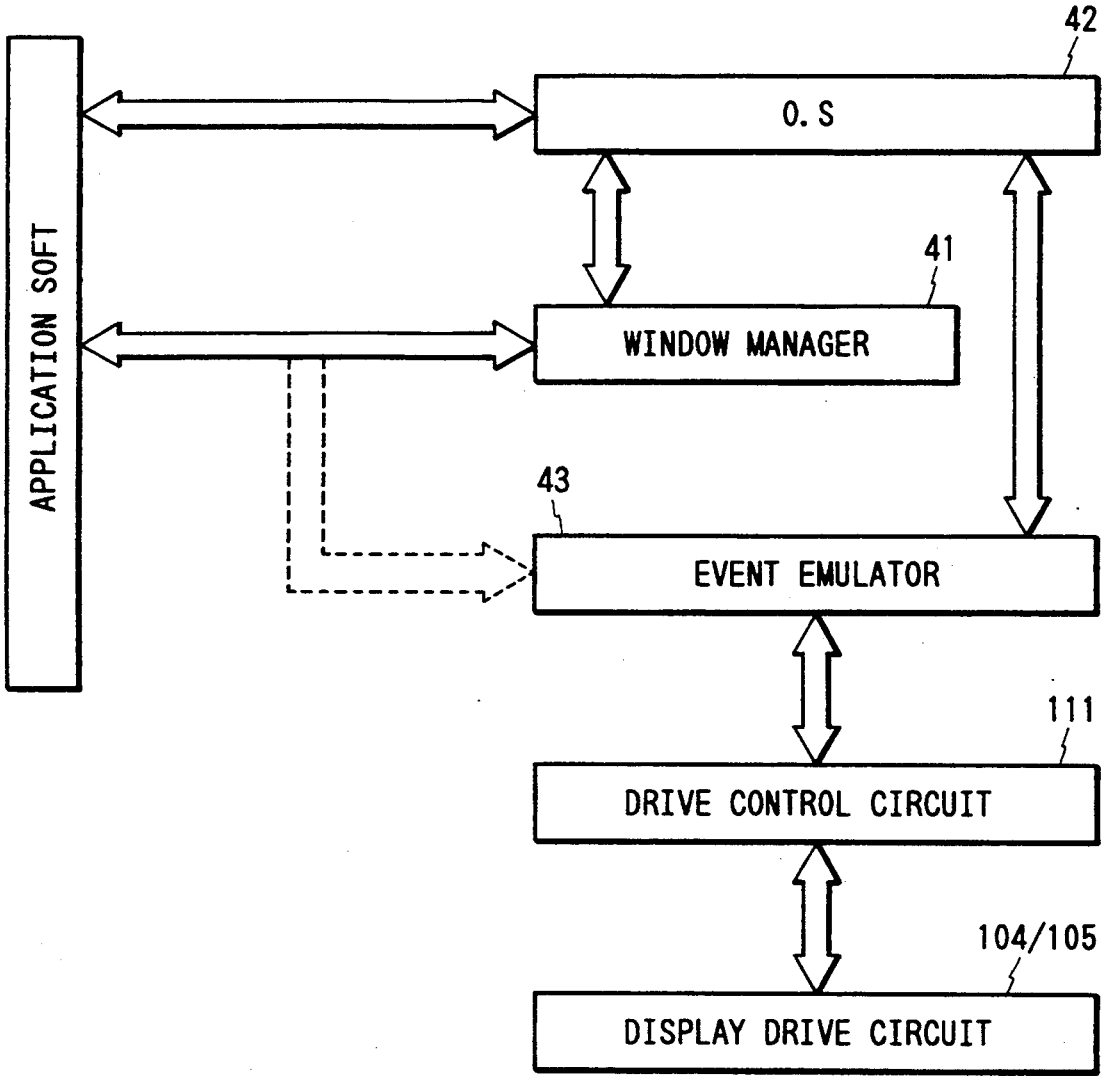
FIG. 4 is a block diagram of a display control program employed in the present invention.

In the present embodiment, a display control program shown in FIG. 4 accepts the display requests 31–38 according to the illustrated communication procedures, and effects the transfer control of the image information to the ferroelectric liquid crystal display device (FLCD) 101 shown in FIG. 1. When at least a request is generated for rewriting an already displayed content, said display control program identifies the corresponding rewriting area and the display process on an image information memory VRAM required for such rewriting, according to the priority, and selectively transfers the image information for the liquid crystal display device 101 in synchronization therewith.

The communication procedures shown in FIG. 4 employ a window manager 41 and an operating system (OS) 42. The operating system (OS) 42 can be composed, for example, of "MS-DOS" (trade name), "Xenix" (trade name) or "OS/2" supplied by Microsoft, Inc. U.S.A. or "Unix" (trade name) by AT&T, Inc., U.S.A., and the window manager 41 can be composed of "MS-Windows ver 1.03", "ver 2.0" or "OS/2 Presentation Manager" (trade names) supplied by Microsoft, Inc., U.S.A. , "X-Window" in the public domain, or "DEC-Window" (trade name) supplied by Digital Equipment Corp., U.S.A. Also an event emulator 43 shown in FIG. 4 can be composed, for example, of a set of "MS-DOS & MS-Windows" or "UNIT & X-Window".

The partial rewriting employed in the present invention is conducted by scanning only the lines in the partial rewritten area, and enables high-speed partial rewriting, because of the memory ability of the ferroelectric liquid crystal device 101. Also the present invention is based on an assumption that the high-speed rewriting of displayed information by the computer system does not take place in many places at any moment in the entire image frame. For example the information from the pointing device (for example mouse) may be displayed with a speed of 30 Hz or lower, since the human eye can track the movement at a higher speed. Similarly the smooth scroll (scroll line by line), usually fastest display, becomes illegible if it is too fast. In practice the scroll is more often conducted by a character or by a certain block, rather than by a line. In computer systems, the scroll is often employed for programming or text editing, and its principal object is the movement of display from a row to next, rather than smoothly gliding movement. Consequently a scroll operation row by row, with a speed of 10 rows/sec., is practically sufficient.

If the mouse font is composed of 32×32 dots and the partial rewriting on FLCD is conducted by non-interlaced scanning, a response speed of:

$$32 \text{ lines} \times 100\ \mu\text{sec/line} = 3.2 \text{ msec} = 312 \text{ Hz} \quad (1)$$

is theoretically possible.

On the other hand, a row-by-row scroll at a speed of 10 row/sec. corresponds to a frame renewing speed of 10 Hz with non-interlaced scanning. Although flickering should be present at 10 Hz, it is practically not a problem, because the change in displayed information is more conspicuous than the flickering, as the entire image frame moves row by row. Consequently, the number of scanning lines drivable by non-interlaced scanning in the row-by-row scroll is given by:

$$(1/10 \text{ Hz})/100\ \mu\text{sec} = 1000 \text{ (lines)} \quad (2).$$

The present invention provides a liquid crystal display based on a partial rewriting scan algorithm, as will be explained in the following, in the graphics controller, employing a data format consisting of image information including scanning line address information as shown in FIGS. 1 and 2, and communication synchronizing means based on the SYNC signal.

The image information is generated by the graphics controller 102 in the host equipment, and is transferred to the display panel 103 by the signal transfer means shown in FIGS. 1 and 2. The graphics controller 102 is principally composed of a central processing unit GCPU 112 and an image information memory VRAM 114, and controls the administration and communication of the image information between the host CPU 113 and the liquid crystal display device 101. The control method of the present invention is principally realized in said graphics controller 102.

Figure 10:
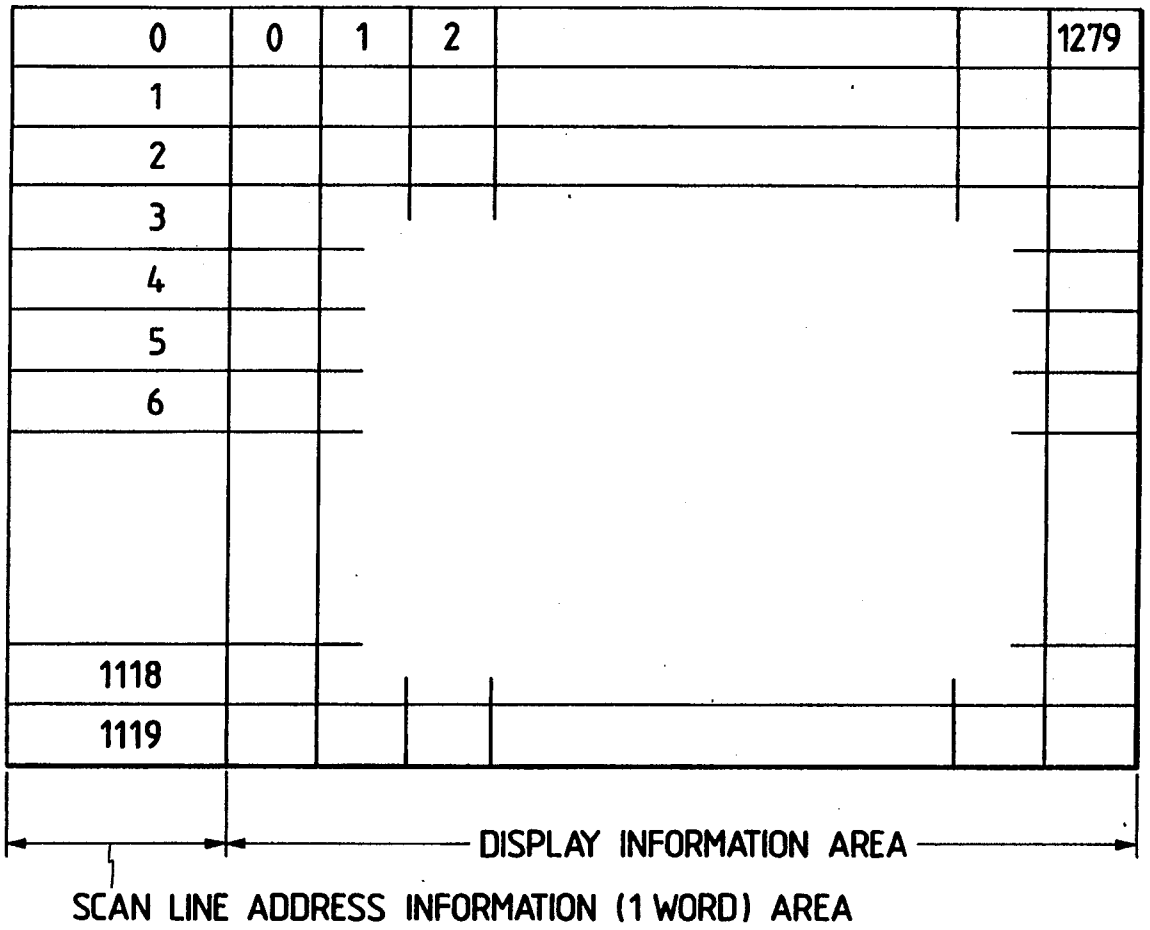
FIG. 10 is a view showing the mapping of scanning line address information and display information on a VRAM employed in the present invention.

Because of the data format consisting of image information involving scanning line address information, said address information mapped on the VRAM 114 as shown in FIG. 10. The VRAM 114 is divided into two areas, which are respectively assigned to the scanning line address information and the display information. In order that the information on the VRAM 114 corresponds one-to-one to the pixels of the display panel 103, the image information is arranged along a horizontal line, and the scanning line information is placed at the front end (left end) of said image information of a line. The GCPU 112 realizes the data format consisting of image information involving scanning line address information, by reading the information by the unit of a line from the left-hand end of the VRAM 114, and sending said information to the liquid crystal display device 101.

Figure 9A:
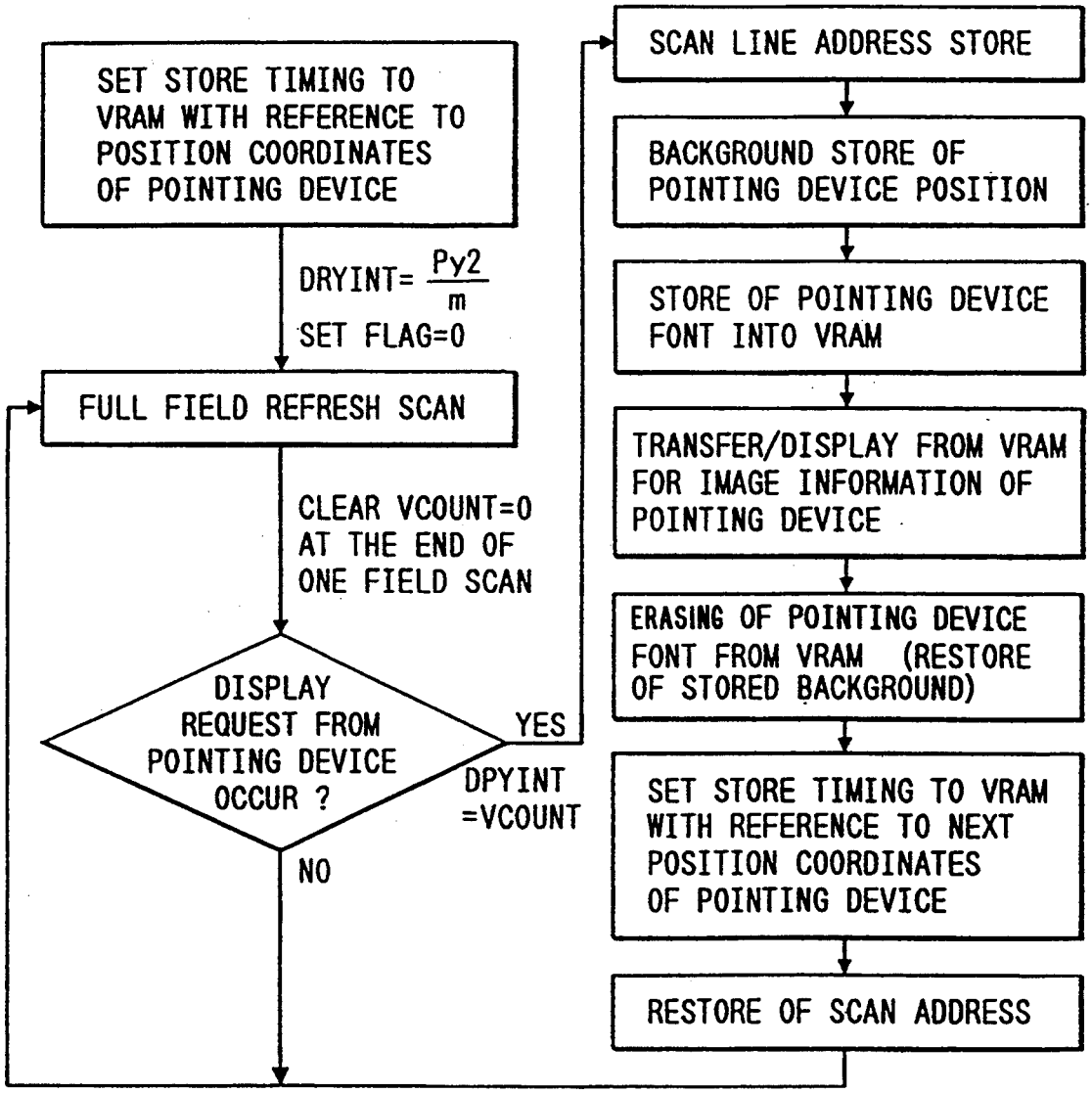
FIG. 9A PRIOR ART
FIG. 9A is a flow chart showing the algorithm of a conventional system.
Figure 9B:
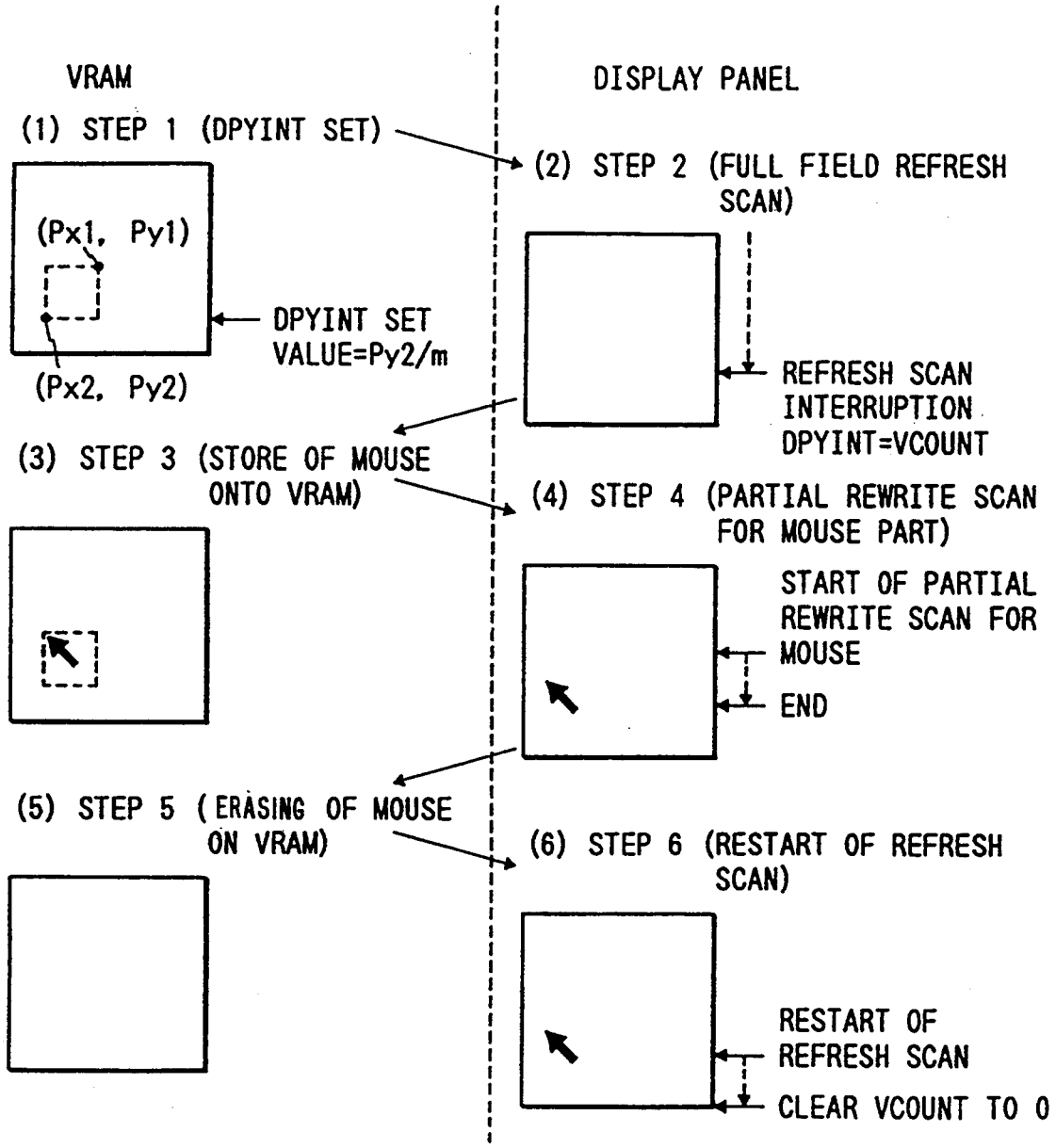
FIG. 9B PRIOR ART
FIG. 9B is a view showing the corresponding flow of display process.

FIG. 9A shows an algorithm employed in the conventional information processing apparatus, and FIG. 9B shows corresponding flow of displays. In FIG. 9A, "Set store timing to VRAM with reference to position coordinate of pointing device" is determined by "VCOUNT" for setting a count to be step increased at every scanning line, and "DPYINT" indicating the set value for display interruption. The "VCOUNT" is cleared to "0" at every field in the refreshing drive. An interruption procedure is started in the GCPU 112 when the value of VCOUNT becomes equal to that of DPYINT. The set value of DPYING is determined by the position coordinate of the pointing device (for example mouse) divided by the number of fields. As shown in FIGS. 9A and 9B, display information required for partial rewriting of the ferroelectric liquid crystal display device 101 (pointing device or popup menu) is registered in advance in the GCPU 112, and a partial rewriting routine is started when a partial rewriting is identified necessary in response to the information from the host CPU 113. In this state, the information of display request (position and font) for the pointing device, obtained from the host CPU 113, is stored in the GCPU 112, and a position coordinate for the pointing device is designated on the VRAM 114 for synchronizing the drive of the display panel 103 with the generation of display request. Then the image information of the pointing device is stored in the VRAM 114, when the count of VCOUNT becomes equal to that of DPYINT.

For example, if the display request for the pointing device alone is processed by a partial rewriting scan while other display requests are processed by total refreshing scan, the position coordinate for the pointing device on the VRAM 114 is ($P_{x1}$, $P_{y1}$) for the upper right corner and ($P_{x2}$, $P_{y2}$) for the lower left corner. Thus, in case a frame is composed of m fields, the DPYINT becomes $P_{y2}/m$, taking the last line of the pointing device font as reference.

Thus, as shown in FIGS. 9A and 9B, the movement of the pointing device can be smoothly displayed in the image frame of the display panel 103 under the entire refreshing scan.

Figures 1, 9C:
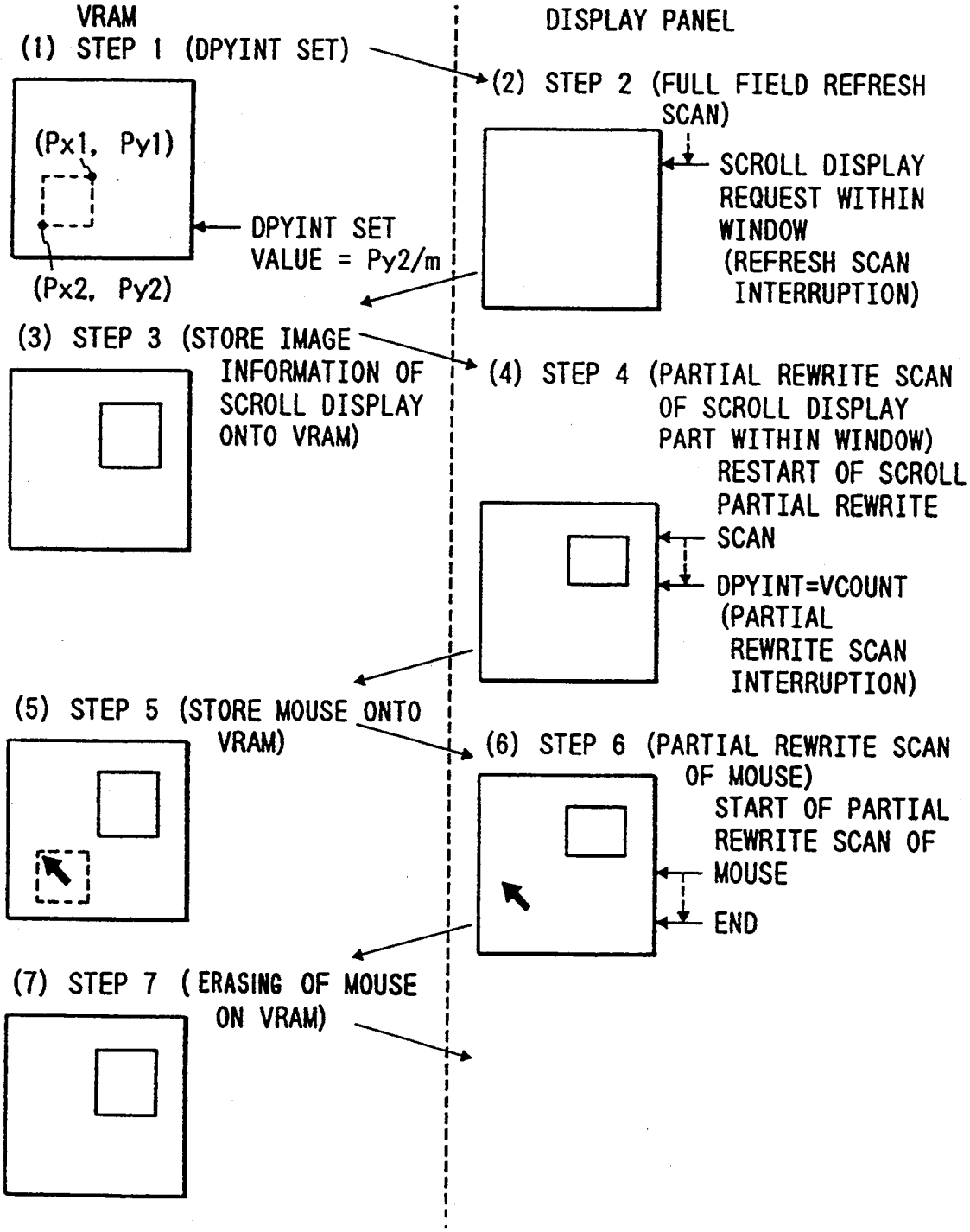
FIG. 9C-1 PRIOR ART
Figures 2, 9C:
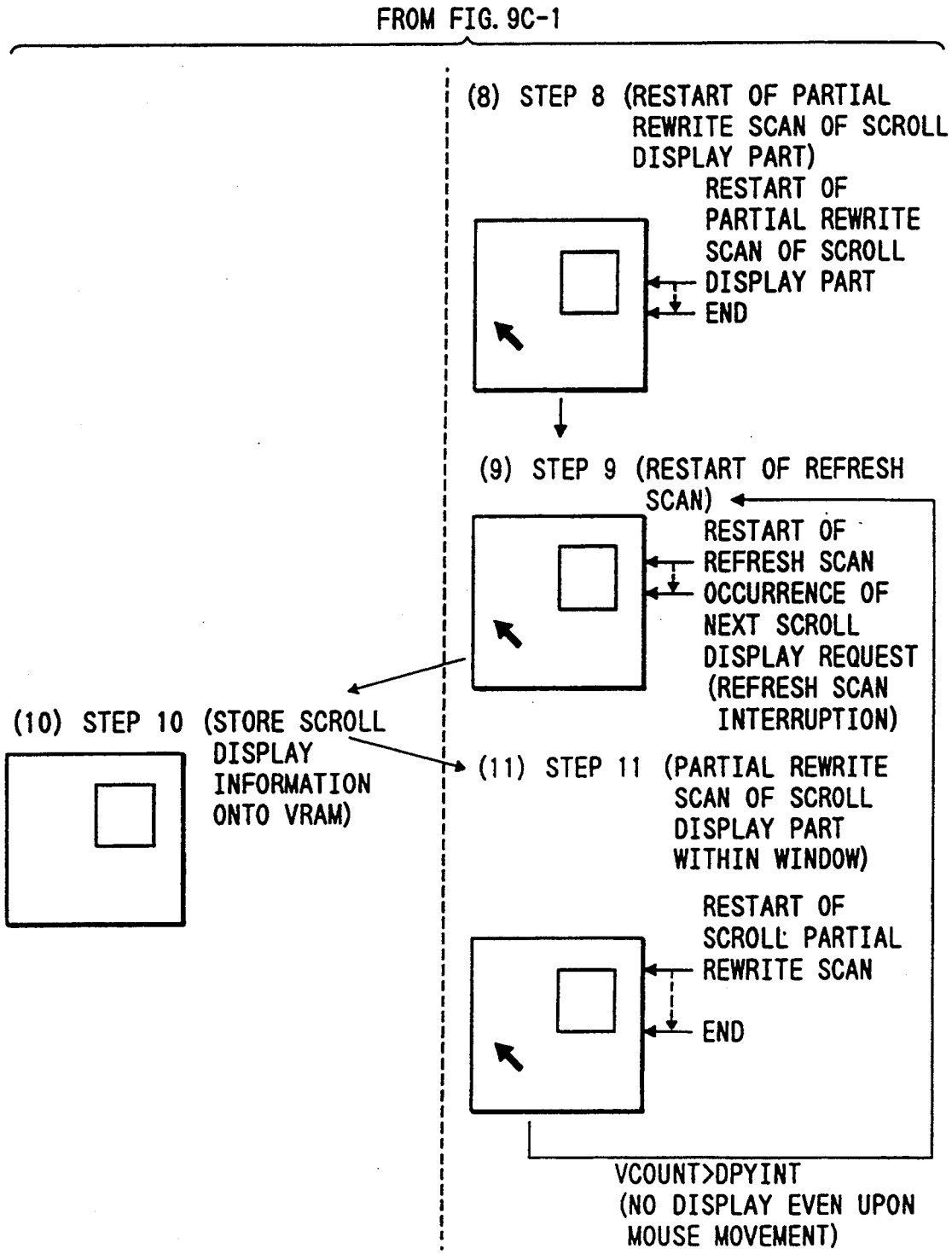
FIG. 9C-2 PRIOR ART

However, in the above-explained system in which the VCOUNT is cleared at every field, said VCOUNT is not cleared to zero but increases beyond the set value of the DPYINT if another display request for partial rewriting scan (for example scroll in a window) occurs in succession. Consequently, if the mouse movement occurs in this state, the image information corresponding to the moving position cannot be stored in the VRAM 114. The corresponding flow of displays is shown in FIG. 9C.

The present invention provides a novel system not associated with the above-mentioned drawback and capable of smoothly displaying the mouse movement when plural display requests for partial rewriting scan occurs at the same time.

Figures 2, 9D:
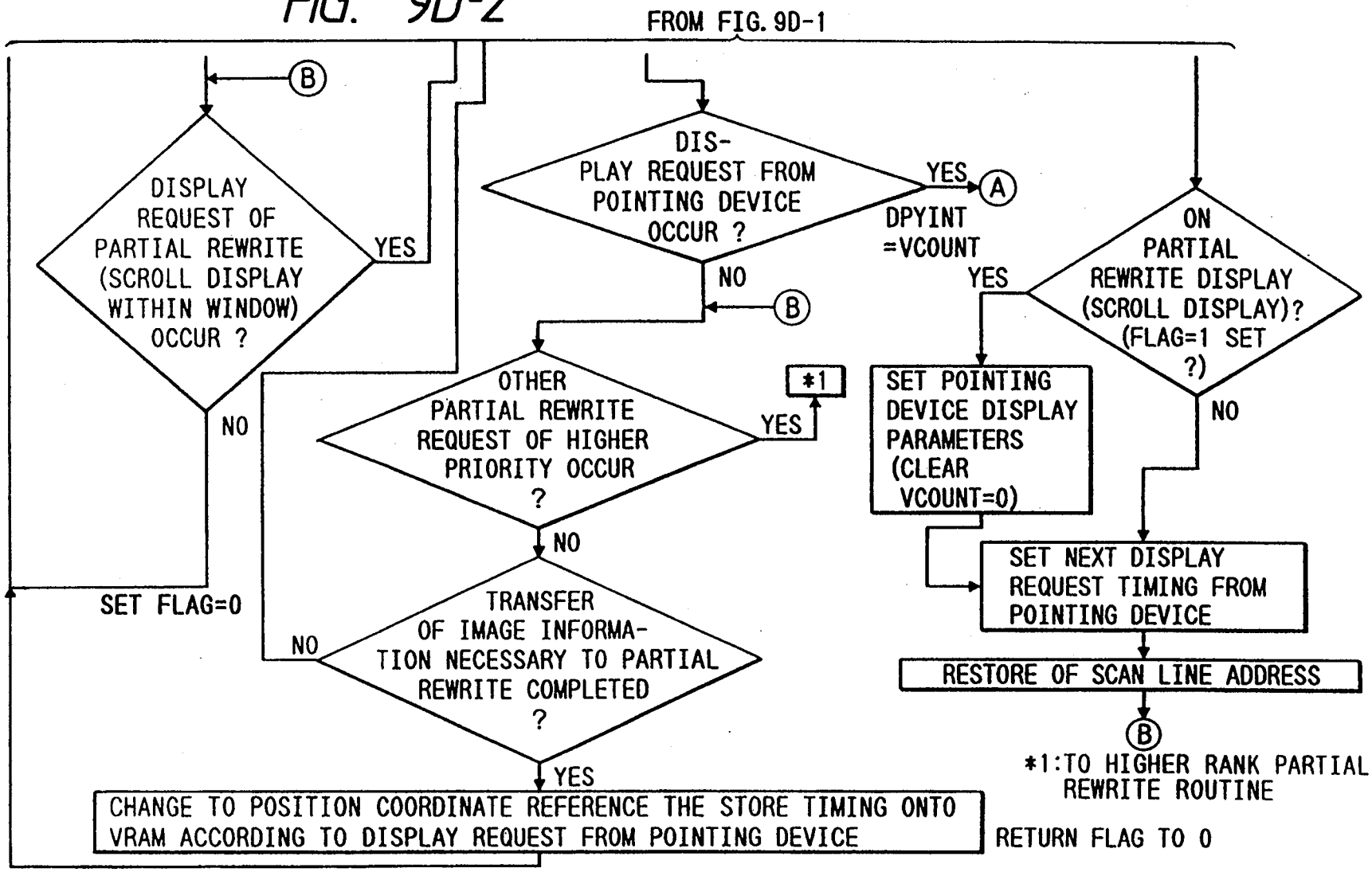
Figure 9E:
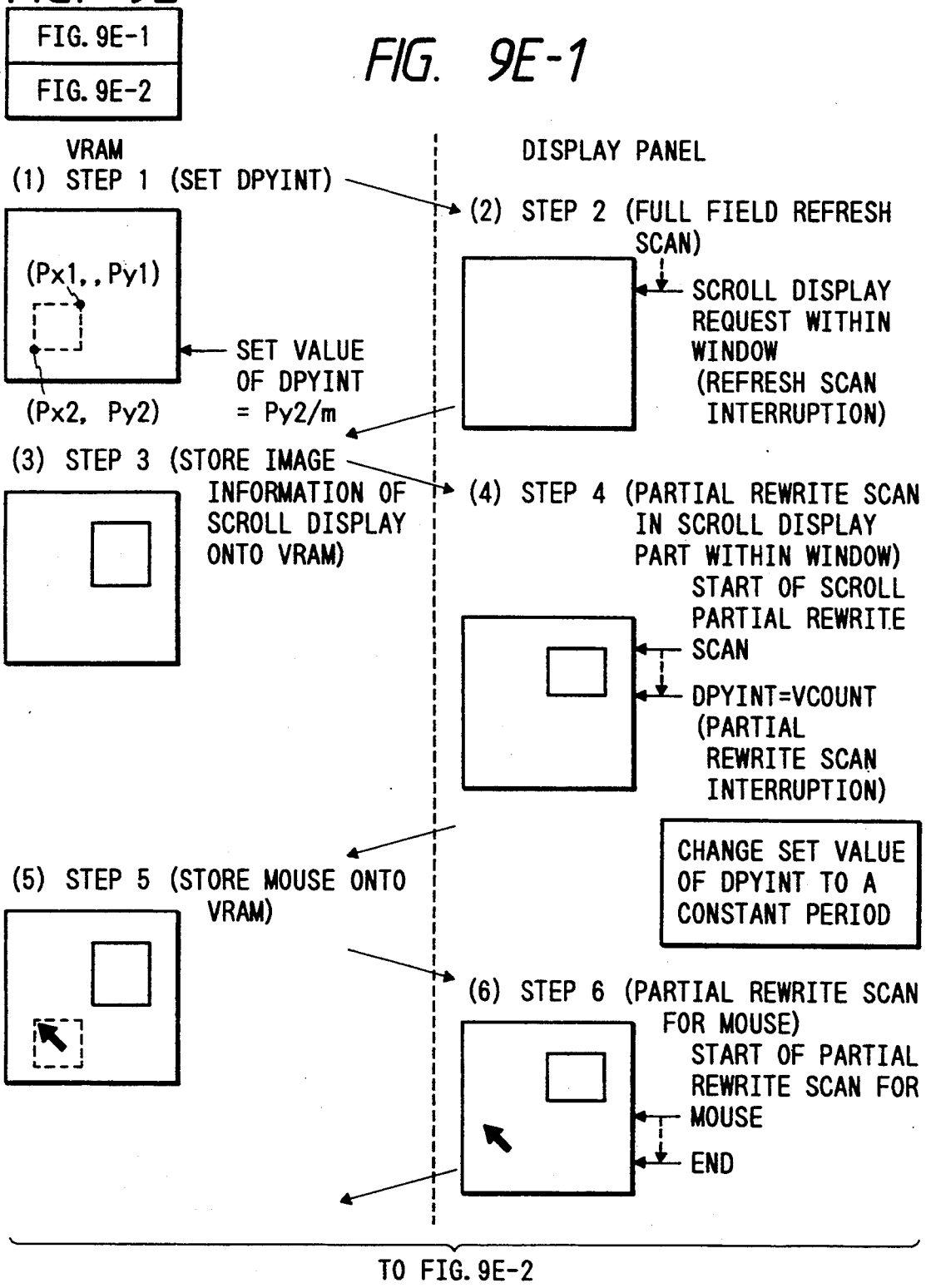
Figures 2, 9E:
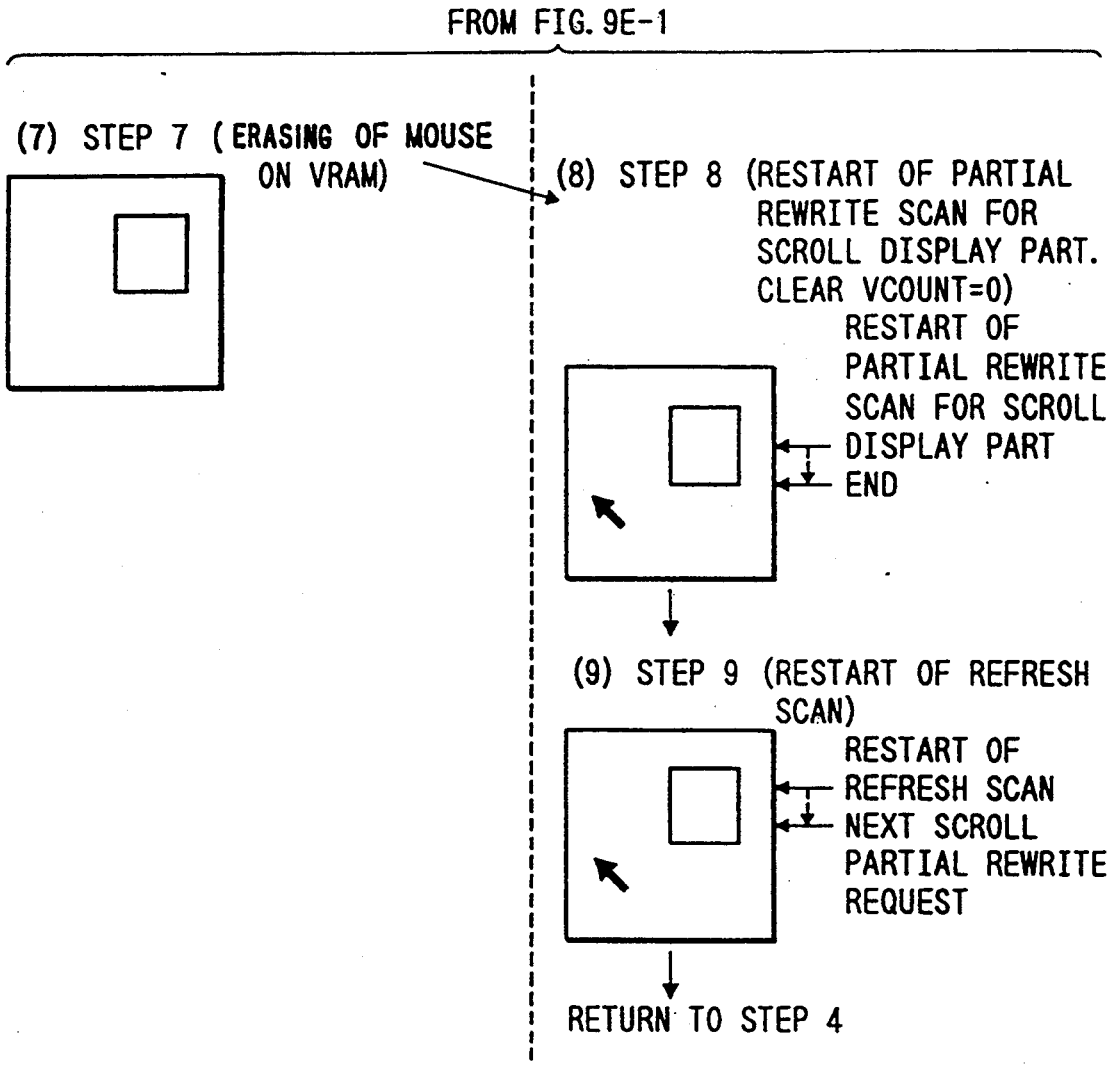

FIG. 9D shows the algorithm of said system, and FIG. 9E shows the flow of displays according to said algorithm.

The algorithm shown in FIG. 9D, employed in the graphics controller 102, sets a flag at "0" at a step for "setting store timing to VRAM with reference to the position coordinate of the pointing device", and sets the flag to "1" at a step for "changing to storage of display request from pointing device into VRAM at a constant interval". Consequently, the DPYINT becomes constant (for example 60 Hz) in this case. The flag is returned to "0" at a step "changing the setting of store timing to VRAM with reference to position coordinate of the pointing device".

Also in this embodiment, if the flag is set at "1" in a step for discriminating "whether another partial rewriting under way?", the sequence proceeds to a step for "clearing VCOUNT to 0".

As explained above, if the partial rewriting is instructed not only for the pointing device but also for the scroll or the key inputs, the position of the above-mentioned $P_{y2}/m$ lines becomes different from the actual position of the pointing device because the number of field lines becomes unfixed. Also in case of a position change in the field at a partial rewriting, if another display request for partial rewriting occurs in succession, the display of the position line for the pointing device is delayed so that the highest priority cannot be given to the display of the pointing device. For this reason, when a display request for partial rewriting other than for the pointing device is generated, the timing of display request for the pointing device is switched from the position-based timing to a constant interval, and the image information is once stored in the VRAM 114 and then transferred to the liquid crystal display device 101. Said transfer is conducted in the unit of a line in a manner similar to the signal transfer method shown in FIG. 2, and, after the transfer of each line, there is monitored the generation of a request for partial rewriting for the pointing device and a request for partial rewriting of a higher priority than that of the partial rewriting currently under way. If a request for partial rewriting for the pointing device is generated, there is initiated a partial rewriting device for the pointing device, and, upon completion of said partial rewriting, there is registered, in the GCPU 112, the position of generation of the next request for partial rewriting of the pointing device. Upon completion of the first-mentioned partial rewriting, the generation of request is again switched to the position-basis.

Thus the aforementioned drawback can be eliminated by registering in the GCPU 112 in such a manner that the display request for the pointing device is generated according to the position thereof on the VRAM 114 in case of a refreshing drive, and, in case of generation of another request for partial rewriting, changing the timing of generation of display request for the pointing device from position basis to a constant interval.

The present invention realizes smooth moving display of mouse even in case scrolls occur in succession in a window in the display frame.

Figure 11:
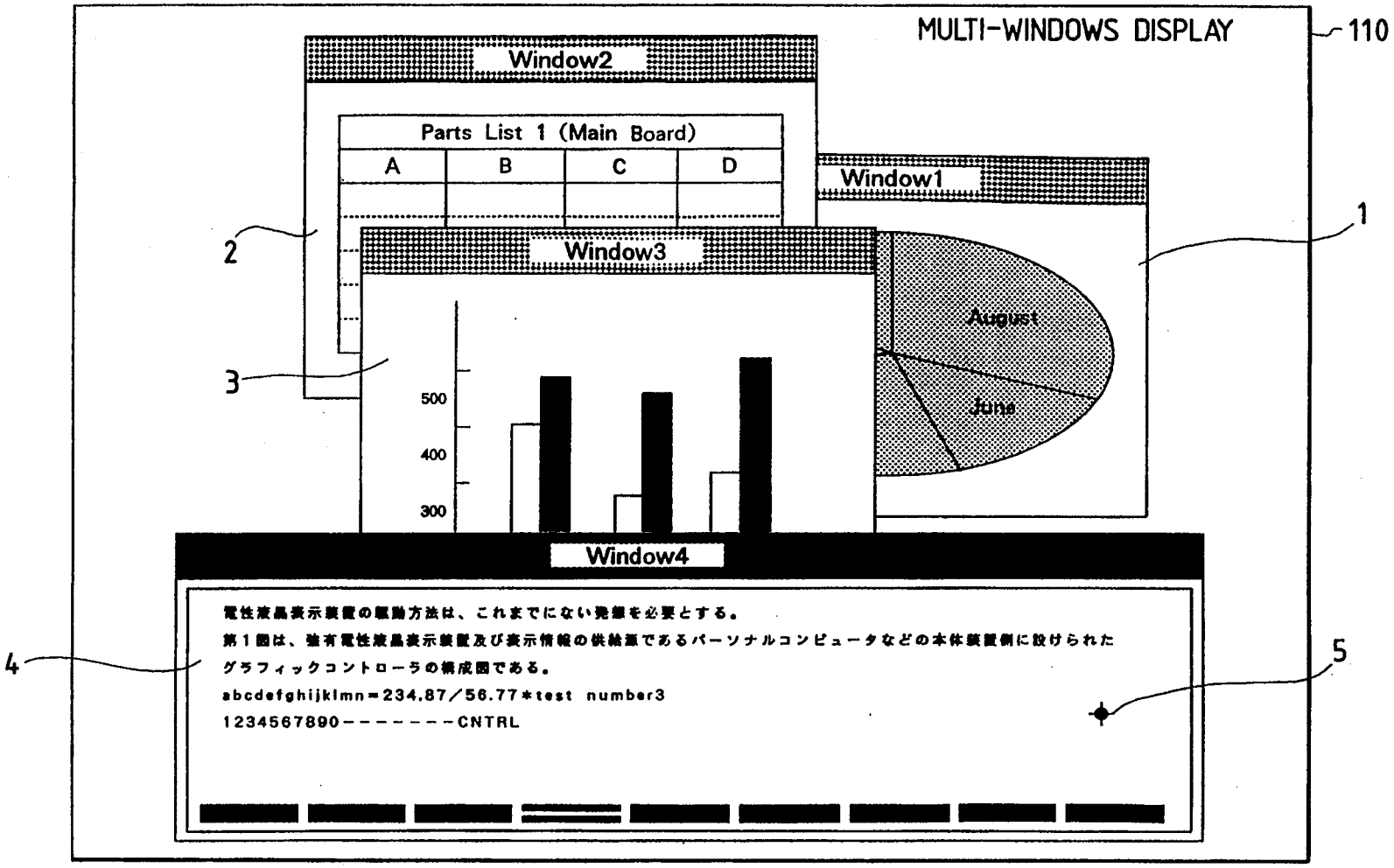
FIG. 11 is a view showing a multi-window display frame in an embodiment of the present invention.

FIG. 11 shows an example of the multi-window display frame 110 of the present invention. A window 1 displays a statistical result by a circular graph; a window 2 shows said result in a table; a window 3 shows said result in a bar chart; a window 4 shows a text in editing; and a point 5 indicates a mouse constituting the pointing device. Let us consider a situation where the mouse moves while the windows 1–3 are in stationary state and the window 4 is in text editing operation by smooth scroll, insertion and deletion of words and texts, movement etc. The scroll and mouse movement are image information requiring partial rewriting in the ferroelectric liquid crystal display device 101. As an example, a horizontal scanning time of 80 μs, used in combination with 1120 scanning lines in the image frame will result in a frame frequency of 10 Hz which is definitely insufficient for tracking the usual mouse movement (≧30 Hz). However the algorithm of the present invention enables the partial rewriting for mouse movement by a branched operation even during the scroll display, by selecting a higher priority for the partial rewriting for the mouse movement than for the text editing in the window 4. Thus, in a display of low frame frequency with memory ability such as the ferroelectric liquid crystal display device 101, multi-window multi-task display function can be realized by giving the highest priority to the movement of the pointing device (mouse).

Figure 5:
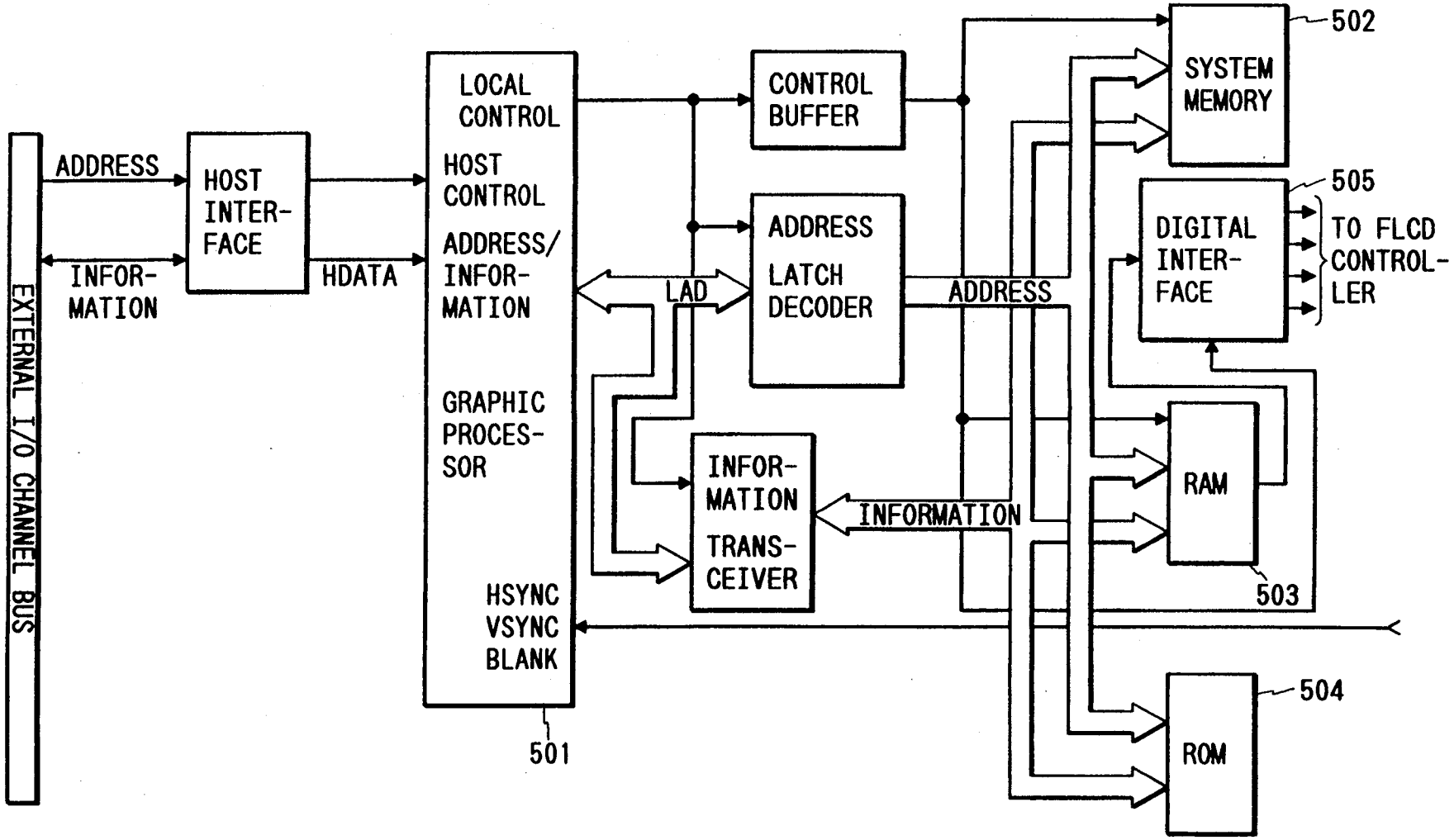
FIG. 5 is a block diagram of a graphics controller employed in the present invention.
Figure 6:
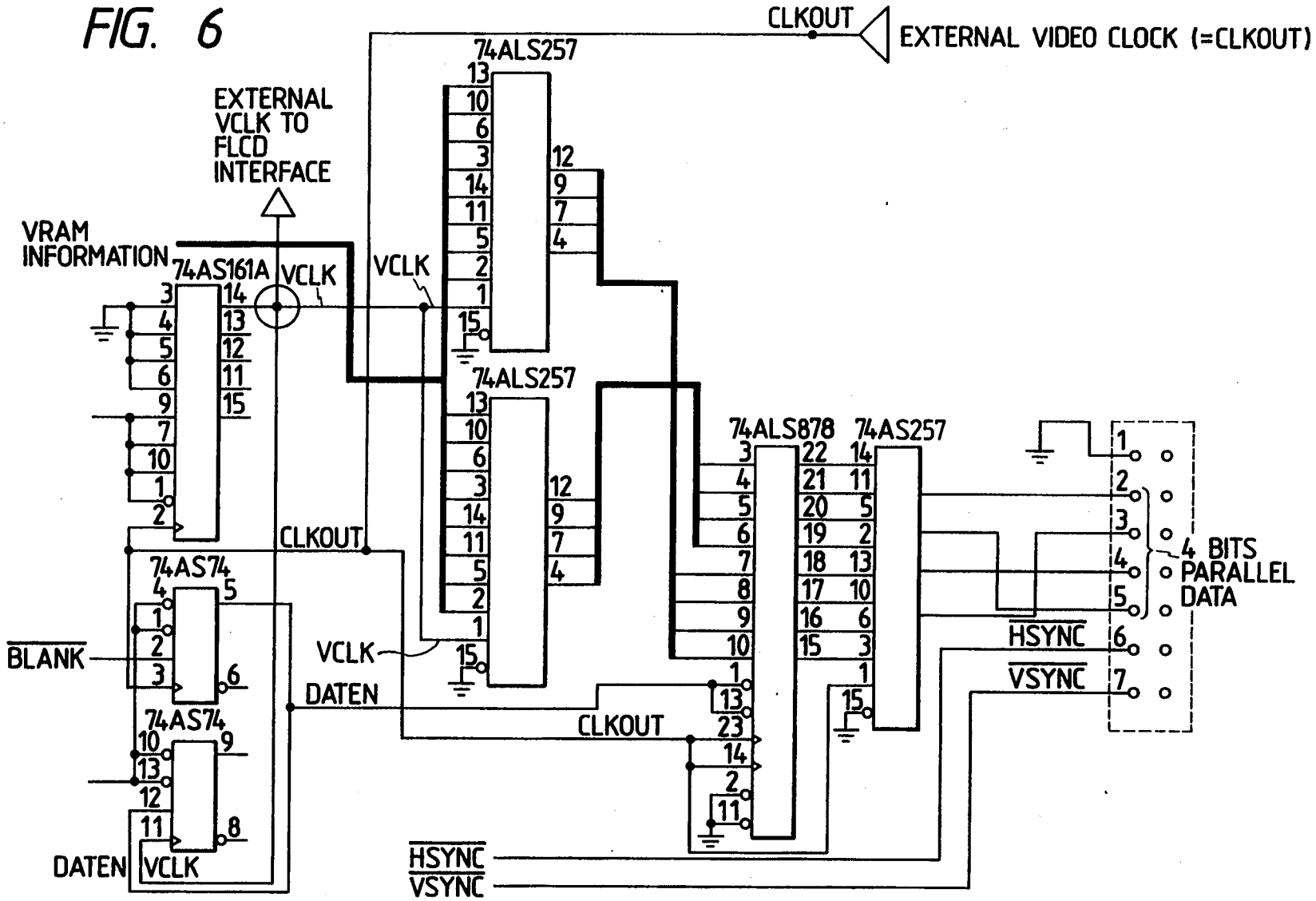
FIG. 6 is a block diagram of a digital interface.
Figure 7:
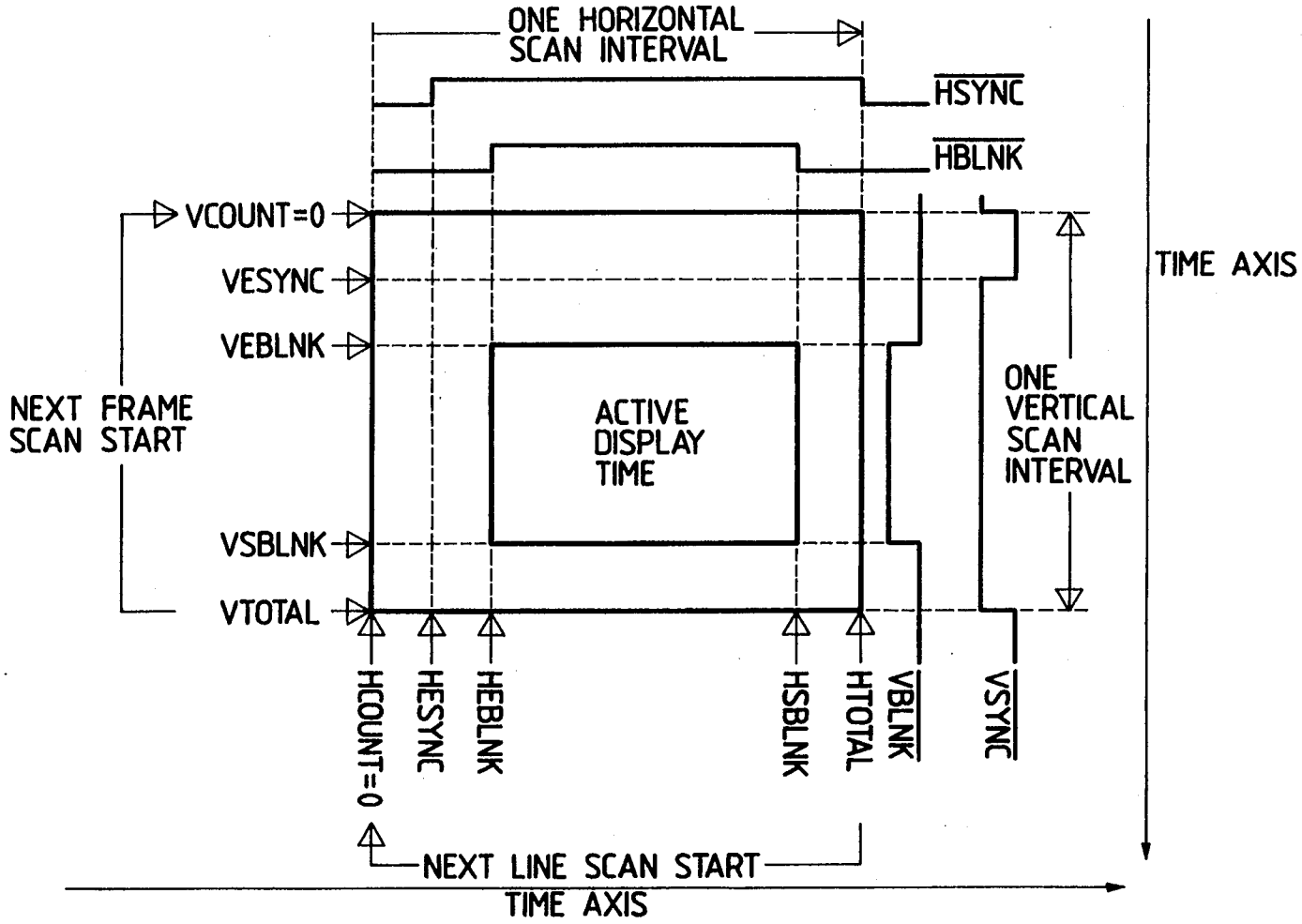
FIG. 7 is a timing chart of an interface for the display drive device employed in the present invention.
Figure 8:
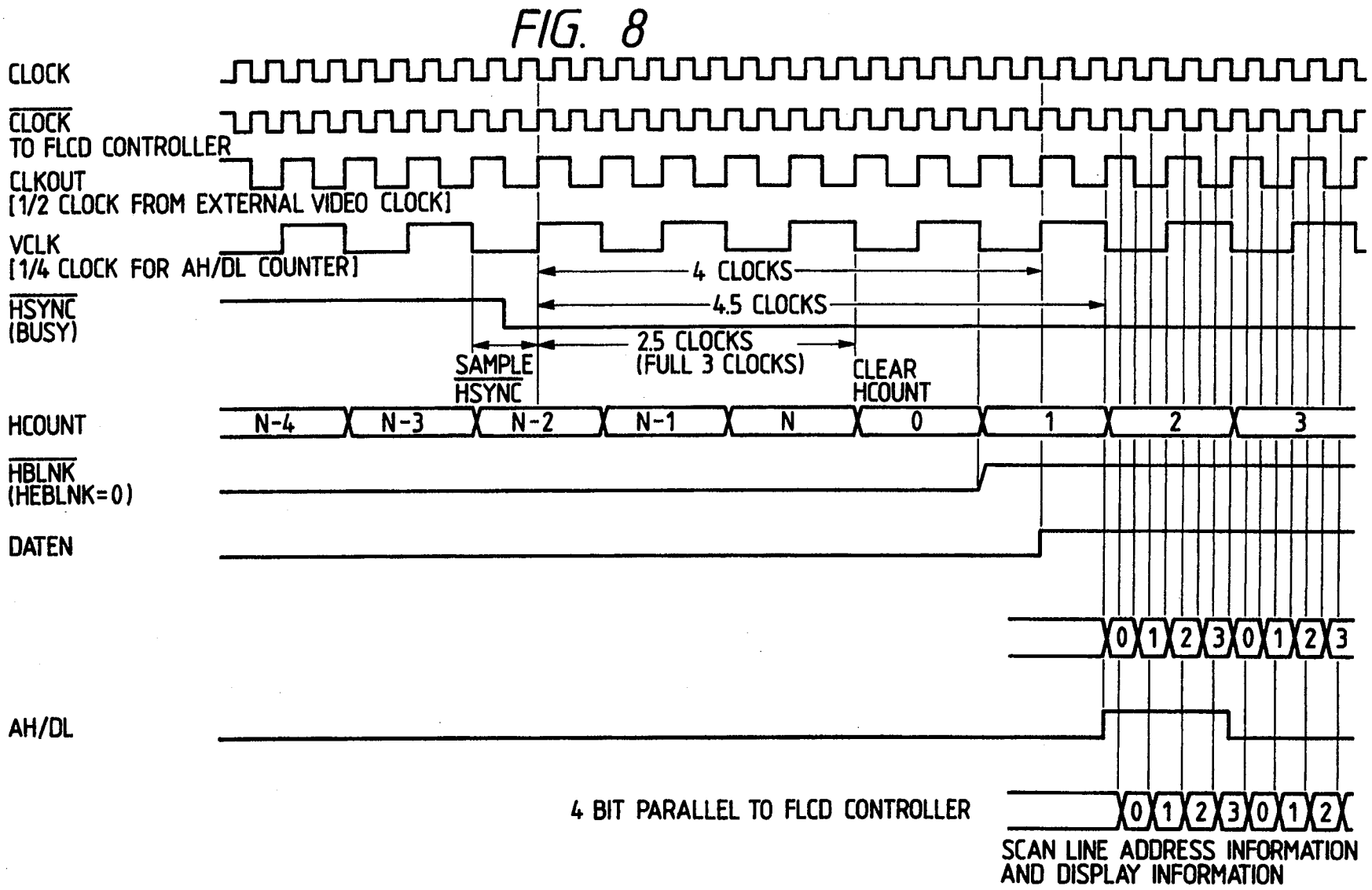
FIG. 8 is a timing chart of an interface for an FLCD controller.

FIGS. 5 and 6 are block diagrams of the graphics controller 102 and the digital interface, and FIGS. 7 and 8 are timing charts of information transfer. The graphics controller 102 employed in the present invention is different from the conventional one principally in that a graphic processor 501 has an exclusive system memory 502, effects not only the control of a RAM 503 and a ROM 504 but also the execution and control of writing instructions to the RAM 503, and is capable of independently programming the information transfer from the digital interface 505 to the FLCD controller and the control of FLCD drive.

Referring to FIG. 6, the digital interface 505 sends the information of the VRAM with a rate of 4 bits/data transfer clock at the last stage, taking synchronization with the drive circuits 104, 105 of the display panel 103 by an external synchronization signals HSYNC/-VSYNC from the FLCD controller 111.

FIG. 7 shows the timing of entire frame rewriting, wherein parameters are the same as those in the timing chart of information transfer shown in FIG. 8. At first, the image information transfer of a line starts when the signal HSYNC in FIG. 8 becomes active (L-level). The L-level state of the HSYNC signal is realized by the FLCD controller 111, indicating the information request from the panel 103. Said information request from the panel 103 is received by the graphic processor 501 shown in FIG. 5, and is processed therein with the timing shown in FIG. 8. Referring to FIG. 8, in response to the HSYNC signal from the panel 103, sampling is made for one cycle of an external video clock signal CLKOUT (or the L-level period of VCLK signal, as said VCLK signal is in fact supplied to the graphic processor 501 for effecting the sampling operation for said L-level period), and a horizontal counter HCOUNT in the prpcessor 501 is cleared after 2.5 cycles of the VCLK signal. Then the parameters HESYNC, HESYNC shown in FIG. 7 are programmed to disable (H-level) of a signal HBLNK shown in FIGS. 7 and 8 immediately before a state HCOUNT=1. In the circuit shown in FIG. 6, a signal DATEN is rendered active (H-level) after a half cycle of the VCLK signal, and, still after a half cycle or after 4.5 cycles from the sampling of the HSYNC signal, the data of a next line are transferred from the VRAM to the FLCK controller 111 by the unit of 4 bits.

The transferred line information consists, as shown in the lower right corner in FIG. 8, of the scanning line address information and the display information of a line, transferred in the unit of 4 bits. The FLCD controller 111 identifies the scanning line address information or the display information respectively when the AH/DL signal is at the H-level or L-level. The display information is written into the scanning line of the FLCD selected by said scanning line address information. Thus the non-interlaced, interlaced or m-multi interlaced scanning by increasing the scanning line address information from the graphic controller shown in FIG. 5, respectively by one, by two or by m at a time. The driving method of the display can be controlled in this manner.

The ferroelectric liquid crystal display generally requires a driving time of about 100 μsec for a scanning line. For example, for a driving time of 100 μsec for a scanning line and for a minimum frame frequency of 30 Hz for avoiding flickering, a still image display without flickering can be obtained:

in case of non-interlaced scanning:

$$(1/30\ \text{Hz})/100\ \mu\text{sec}=333\ (\text{lines}) \tag{4}$$

scanning lines;

in case of interlaced scanning:

$$(1/30\ \text{Hz})\times 2/100\ \mu\text{sec}=666\ (\text{lines}) \tag{5}$$

scanning lines; or in m-multi interlaced scanning:

$$(1/30\ \text{Hz})\times m/100\ \mu\text{sec}=333\times m\ (\text{lines}) \tag{6}$$

scanning lines. The experiment of the present inventors confirmed that the flickering was not observed even at m=32. Stated differently, flicker-free display is possible even with a display panel 103 having:

$$(1/30\ \text{Hz})\times 32/100\ \mu\text{sec}\approx 332\times 32=10656\ (\text{lines}) \tag{7}$$

scanning lines, so that a conventionally unachieved high resolution for the flap panel display is rendered theoretically possible.

In FIG. 6, 74AS161A, 74AS74, 74ALS257, 74ASL878 and 74AS257 indicate IC codes, and the numbers indicate pin numbers.

Figures 1, 12B:
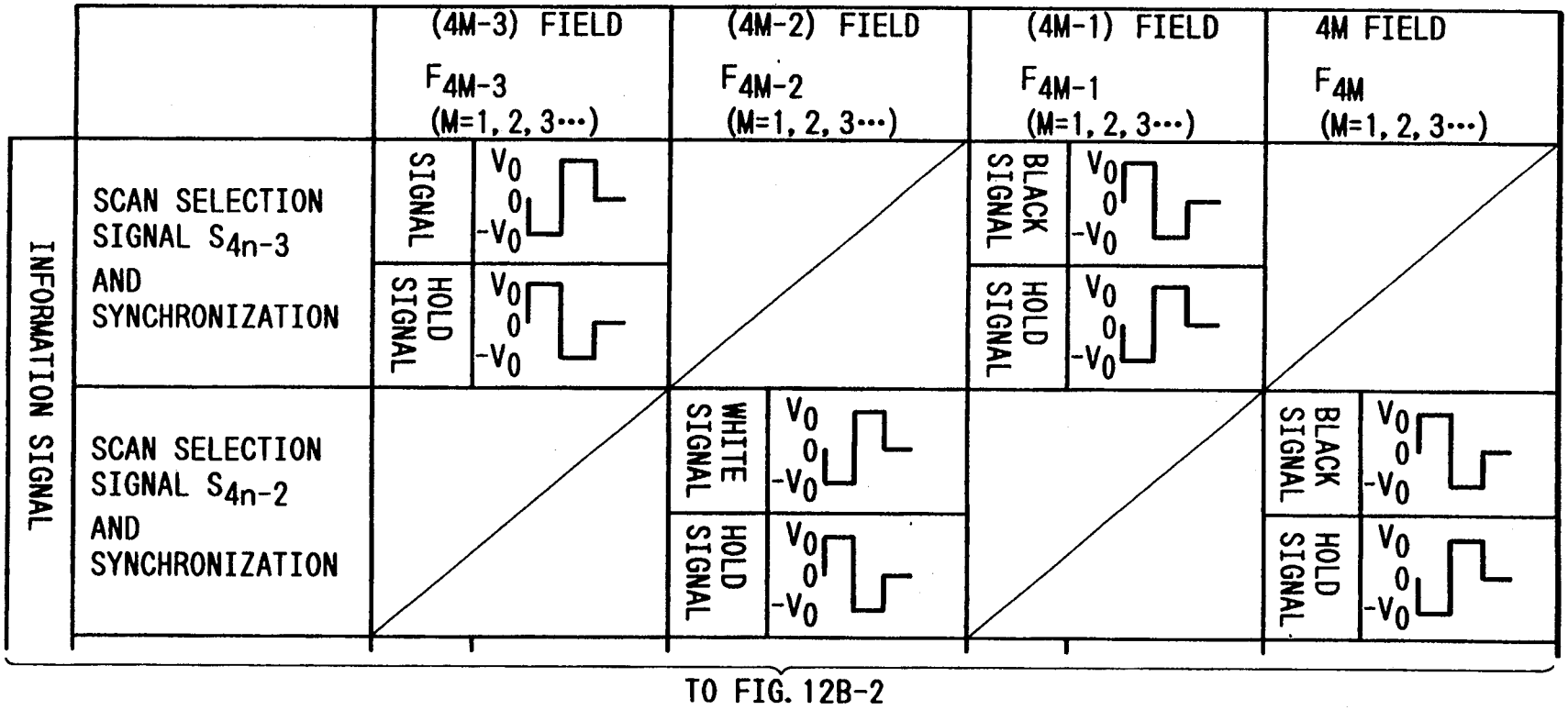
Figures 2, 12B:
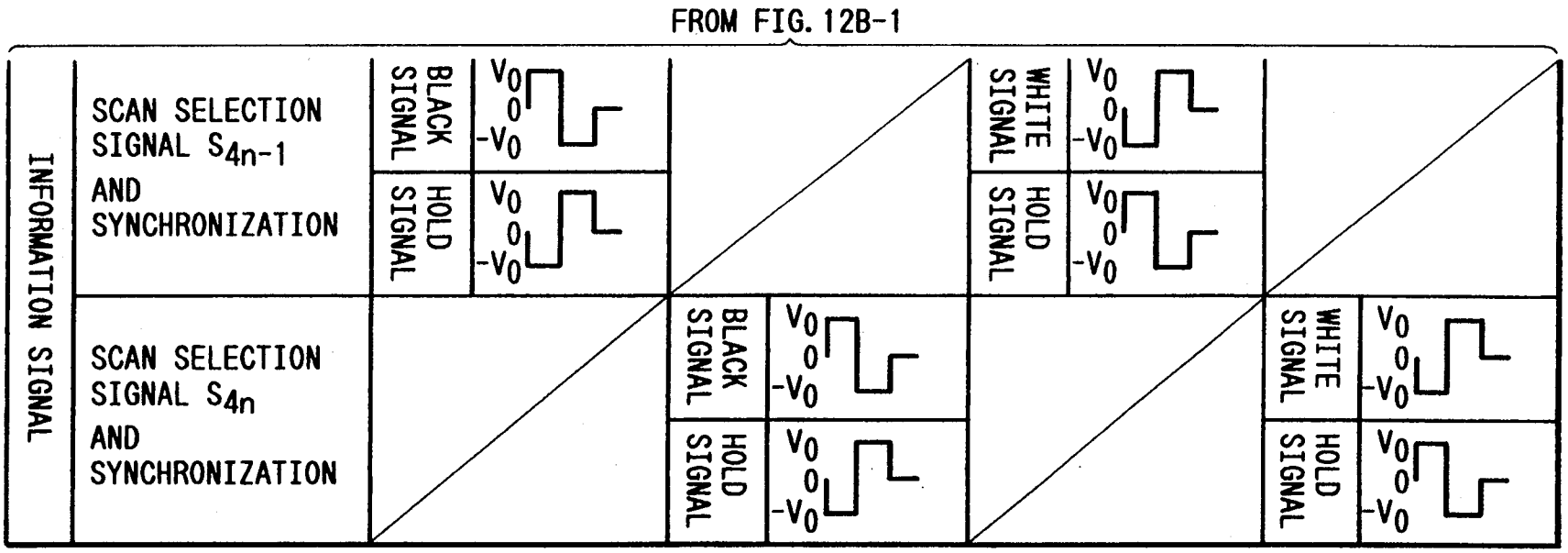

FIGS. 12A and 12B show examples of drive signals in the multi interlaced scanning employed in the present invention.

In FIGS. 12A and 12B there are shown a scan selection signal $S_{4n-3}$ (n=1, 2, 3, . . . ) to be supplied to a (4n-3)-th scanning electrode, a scan selection signal $S_{4n-2}$ to be supplied to a (4n-2)-th scanning electrode, a scan selection signal $S_{4n-1}$ to be supplied to a (4n-1)-th scanning electrode, and a scan selection signal $S_{4n}$ to be supplied to a 4n-th scanning electrode in a (4M-3) field $F_{4M-3}$, a (4M-2) field $F_{4M-2}$, a (4M-1) field $F_{4M-1}$ and a 4M field $F_{4M}$ (a field means a vertical scanning period wherein M=1, 2, 3, . . . ). As shown in FIGS. 12A and 12B, the scan selection signal $S_{4n-3}$ has mutually opposite voltage polarities (with respect to the voltage of a scan non-selection signal) at the same phase in the fields $F_{4M-3}$ and $F_{4M-1}$, but does not effect the scanning in the fields $F_{4M-2}$ and $F_{4M}$. The scan selection signal $S_{4n-1}$ behaves in a similar manner. Also the scan selection signals $S_{4n-3}$ and $S_{4n-1}$ applied in a field period have mutually opposite voltage polarities at a same phase.

Similarly the scan selection signal $S_{4n-2}$ has mutually opposite voltage polarities (with respect to the voltage of the scan non-selection signal) at the same phase in the fields $F_{4M-2}$ and $F_{4M}$, but does not effect the scanning in the fields $F_{4M-3}$ and $F_{4M-1}$, and the scan selection signal $S_{4n}$ behaves in a similar manner. Also the scan selection signals $S_{4n-2}$ and $S_{4n}$ applied in a field period have mutually opposite voltage polarities at a same phase.

In the example of drive signals shown in FIGS. 12A and 12B, a third phase is provided for interrupting the display over the entire image frame (for example by applying zero voltage to all the pixels constituting the image frame), so that the third phase of each scan selection signal is selected at voltage zero (same as the voltage of the scan non-selection signal).

The information signal applied to the signal electrode in the (4M-3)-th field $F_{4M-3}$ is, for the scan selection signal $S_{4n-3}$, either a white signal (in synthesis with the scan selection signal $S_{4M-3}$ to provide a voltage $3V_0$ in the 2nd phase in excess of the threshold voltage of the ferroelectric liquid crystal thereby forming a white pixel) or a hold signal (in synthesis with the scan selection signal $S_{4n-3}$ to provide a voltage $\pm V_0$ not exceeding said threshold voltage). Also for the scan selection signal $S_{4n-1}$, there is selected either a black signal (in synthesis with the scan selection signal $S_{4n-1}$ to provide a voltage $-3V_0$ in the second phase in excess of the threshold voltage of the ferroelectric liquid crystal thereby forming a black pixel) or a hold signal (in synthesis with the scan selection signal $S_{4n-1}$ to provide a voltage $\pm V_0$ not exceeding said threshold voltage). The information signal is supplied without change to the (4n-2)-th or 4n-th scanning electrode as the scan non-selection signal is applied thereto.

In the succeeding (4M-2)-th field $F_{4M-2}$, the information signal supplied to the signal electrode is, for the scan selection signal $S_{4n-2}$, either a black signal or a hold signal as explained above, and, for the scan selection signal $S_{4n}$, either a white signal or a hold signal as explained above. The information signal is applied without change to a (4n-3)-th or (4n-1)-th scanning electrode, as the scan non-selection signal is supplied thereto.

Then, in the succeeding (4M-1)-th field $F_{4M-1}$, the information signal applied to the signal electrode is, for the scan selection signal $S_{4n-3}$, either a black signl or a hold signal as explained above, and, for the scan selection signal $S_{4n-1}$, either a white signal or a hold signal as explained above. The information signal is applied without change to a (4n-2)-th or 4n-th scanning electrode, as the scan non-selection signal is supplied thereto.

In the succeeding 4M-th field $F_{4M}$, the information signal applied to the signal electrode is, for the scan selection signal $S_{4n-2}$, either a black signal or a hold signal as explained above, and, for the scan selection signal $S_{4n}$, either a white signal or a hold signal as explained above. The information signal applied without change to a (4n-3)-th or (4n-1)-th scanning electrode, as the scan non-selection signal is supplied thereto.

Figure 13A:
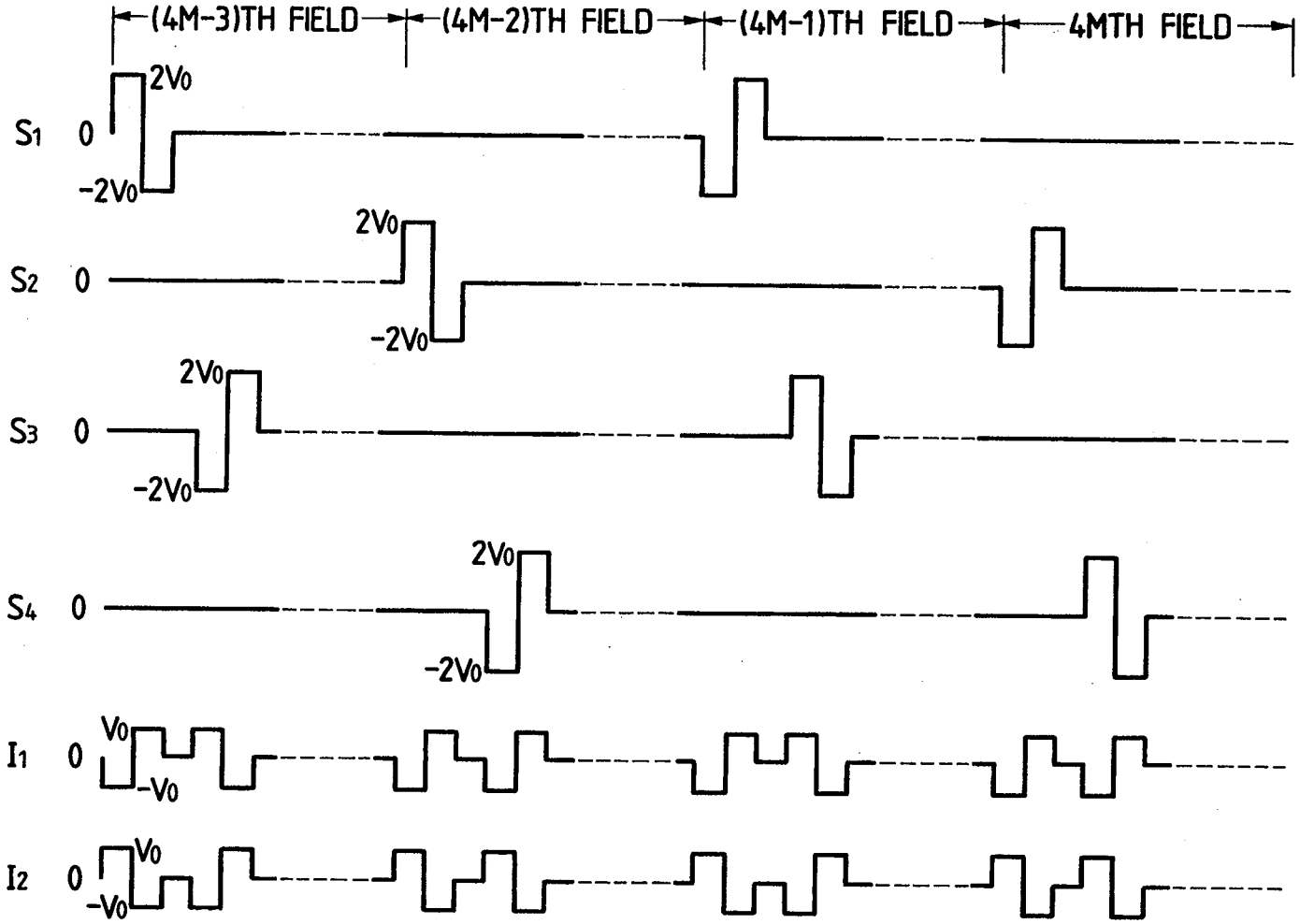
FIGS. 13A to 13C are timing charts of said drive signals.
Figure 13B:
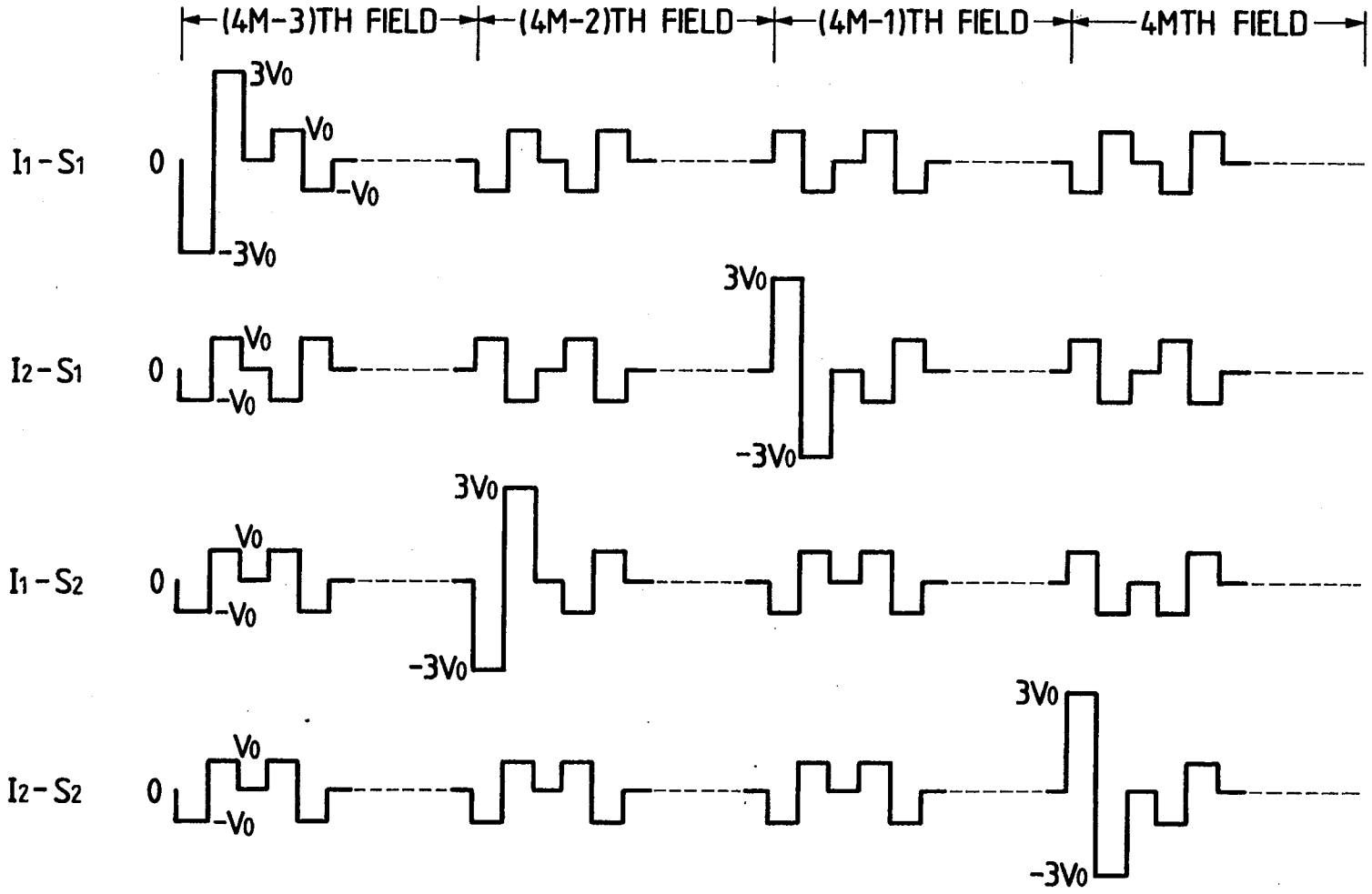
Figure 13C:
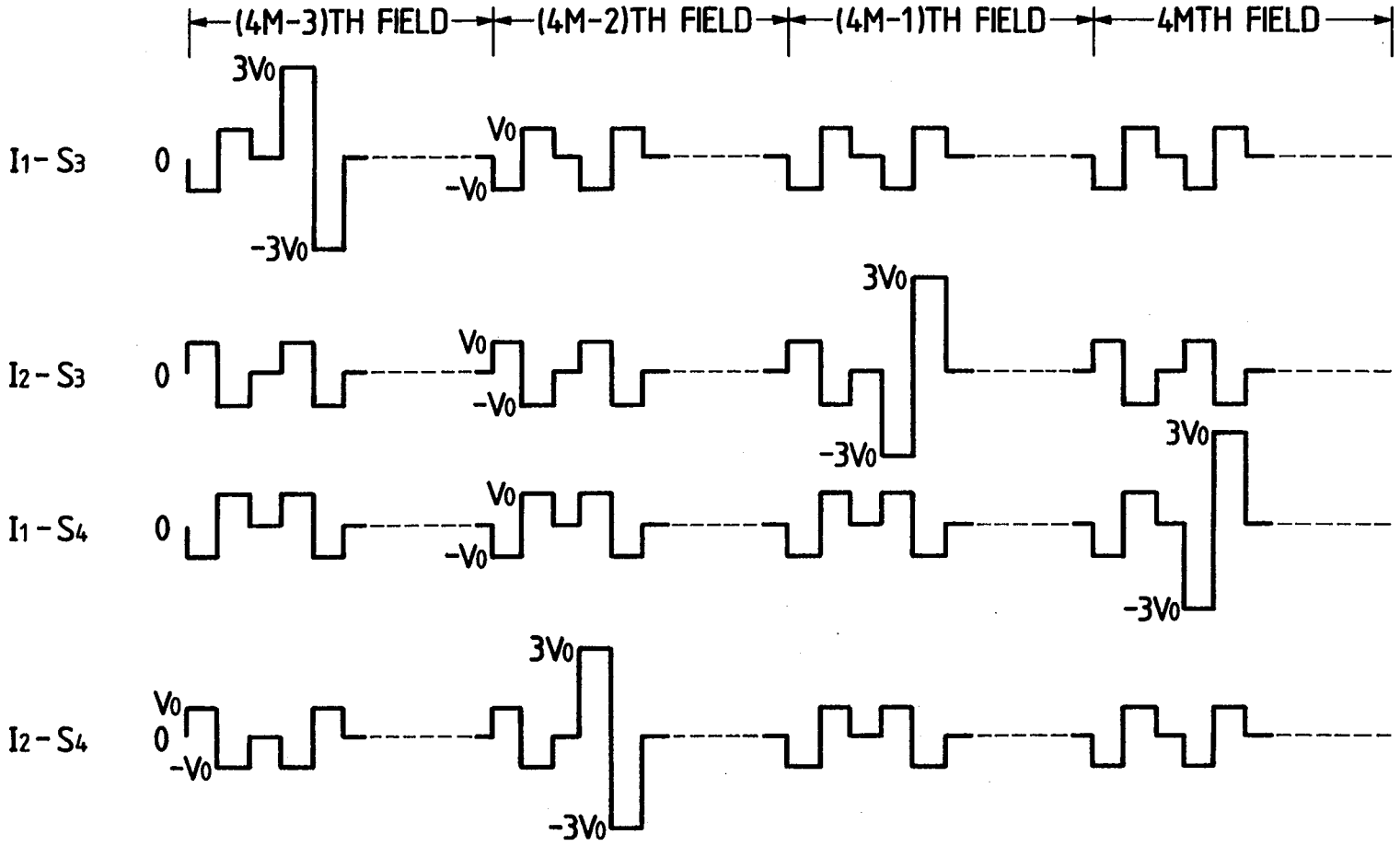
Figure 13D:
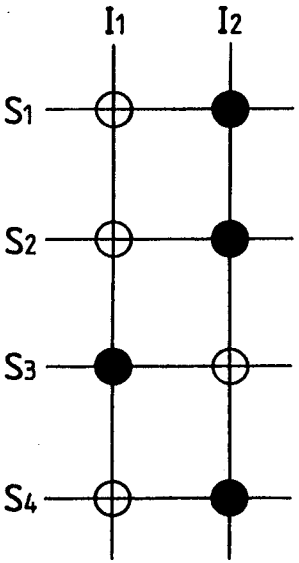
FIG. 13D is a schematic view showing a corresponding display state of pixels.

FIGS. 13A, 13B and 13C are timing charts when drive signals shown in FIGS. 12A and 12B are under for writing a display state shown in FIG. 13D, wherein white and black pixels are respectively represented by white and black circles. In FIG. 13B, $I_1$-$S_1$ indicates the time-sequential voltage wave applied to the crossing point of the scanning electrode $S_1$ and the signal electrode $I_1$; $I_2$-$S_1$ indicates that applied to the crossing point of the scanning electrode $S_1$ and the signal electrode $I_2$; $I_1$-$S_2$ indicates that at the crossing point of the scanning electrode $S_2$ and the signal electrode $I_1$; and $I_2$-$S_2$ indicates that applied to the crossing point of $S_2$ and $I_2$.

The present invention is not limited to the above-epxlained drive signals. For example the scanning operation can be made every four, five, six, seven, or preferably every eight or more scanning lines. Also the scan selection signal may be inverted in polarity in every field as shown in FIG. 7, or can be of a same polarity in all the fields.

Figure 14:
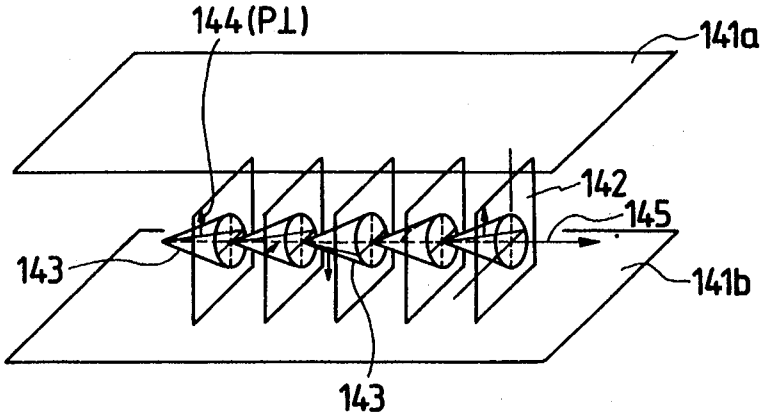
FIGS. 14 and 15 are perspective views of ferroelectric liquid crystal cell employed in the present invention.
Figure 15:
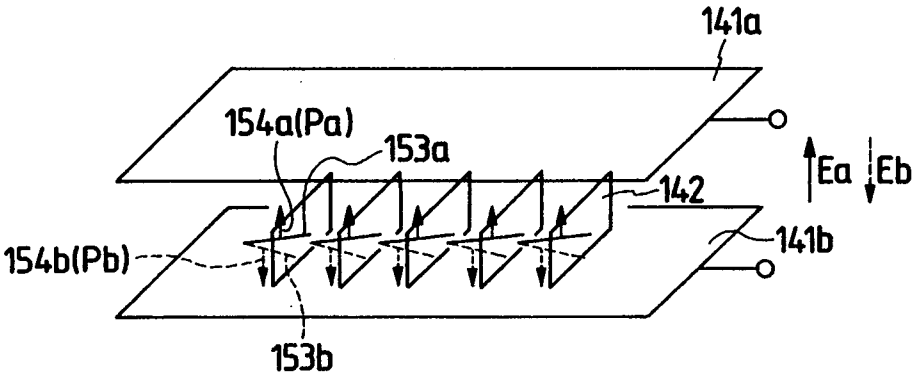

FIG. 14 is a schematic view of a ferroelectric liquid crystal cell, wherein substrates (glass plates) 141*a*, 141*b* coated with transparent electrodes such as $In_2O_3$, $SnO_2$ or ITO (indium tin oxide) sandwiched therebetween a liquid crystal of SmC* phase in such a manner that the liquid crystal molecular layer 142 is perpendicular to the glass planes. A thick line 143 represents a liquid crystal molecule having a dipole moment (P⊥) 144 perpendicular to said molecule. When a voltage exceeding a threshold value is applied between the electrodes of the substrates 141*a*, 141*b*, the spiral structure of the liquid crystal molecules 143 is destroyed, and the orientation thereof can be modified in such a manner that the dipole moments 144 are all aligned along the direction of electric field. The liquid crystal molecule 144 has an oblong form, and shows anisotropy in refractive index between the longitudinal direction and the transversal direction. It will therefore be easily understood that an optical modulating device, varying the optical characteristics by the applied voltage, can be obtained by placing mutually crossing polarizers above and below the glass plates. When the thickness of the liquid crystal cell is made sufficiently thin, for example 1 μ, the spiral structure of the liquid crystal molecules is disassembled as shown in FIG. 15 even in the absence of electric field, and the dipole moment Pa or Pb assumes an upward state 154*a* or a downward state 154*b*. When such cell is given an electric field Ea or Eb of different polarities exceeding a certain threshold value, as shown in FIG. 15, the dipole moment assumes an upward state 154*a* or a downward state 154*b* with respect to the vector of the electric field Ea or Eb, whereby the liquid crystal molecule is oriented either in a first stable state 153*a* or in a second stable state 153*b*.

The use of such ferroelectric liquid crystal in an optical modulating device provides following two advantages; first being an extremely fast response, and second being the bistable state of orientation of the liquid crystal molecule. Said second advantage will be explained in the following with reference to FIG. 15. The application of the electric field Ea causes the orientation of the liquid crystal molecule in the first stable state 153*a*, which is retained even when the electric field is removed. Also the application of the electric field Eb causes the orientation of the liquid crystal molecule in the second stable state 153*b*, which is also retained after the electric field is removed. Such oriented state is retained unless the applied electric field exceeds a certain threshold value. For effectively realizing such fast response and bistable property, the cell should be as thin as possible, generally in a range of 0.5 to 20 μ, preferably in a range of 1–5 μ.

As explained in the foregoing, in a partial rewriting in a display device with memory property such as a ferroelectric liquid crystal display device, the display request for a pointing device is generated by the position thereof on a VRAM, but is generated at a constant interval in case another display request for partial rewriting is generated, whereby the high-speed display for example for high-speed movement of the pointing device can be realized on a display device driven with a low frame frequency, such as the ferroelectric liquid crystal display, and smooth high-speed moving display can be realized.

We claim:

1. An information processing apparatus comprising:

a) an image information memory for storing image information;

b) first means for controlling the start of storage of image information associated with a generated graphics event into said memory based on a display request from a pointing device, with reference to the position coordinate of said graphic event, thereby storing the image information into said image information memory;

c) second means for controlling the storage of the image information associated with a generated graphics event into said memory at a constant interval based on the display request from the pointing device, thereby storing the image information into said image information memory;

d) third means for storing the image information for one frame of the display into said image information memory;

e) fourth means for storing image information for a window display into said image information memory; and f) fifth means for controlling an image transfer from said image information memory so that when, during storing of the image information by said third means, without the display request for the window display, the display request from the pointing device is generated, said first means controls the start of storage of image information when, during storing of the image information by said third means, the display request of the window display and the display request from the pointing device are produced, the display request of the window display is met by said fourth means, and the display request from the pointing device is met by said second means.

2. An information processing apparatus according to claim 1, wherein the image information for the window display is for a moving image.

3. An information processing apparatus according to claim 2, wherein the image information for the moving image is for a scrolling image display.

4. A display system comprising:

a) an image information memory for storing image information;

b) first means for controlling the start of storage of image information associated with a generated graphics event into said memory based on a display request from a pointing device, with reference to the position coordinate of said graphics event, thereby storing the image information into said image information memory;

c) second means for controlling the storage of the image information associated with a generated graphics event into said memory at a constant interval based on the display request from the pointing device, thereby storing the image information into said image information memory;

d) third means for storing the image information for one frame of the display into said image information memory;

e) fourth means for storing image information for a window display into said image information memory;

f) fifth means for controlling an image transfer from said image information memory so that when, during storing of the image information by said third means, without the display request for the window display, the display request from the pointing device is generated, said first means controls the start of storage of image information while, during the storing of the image information by said third means, the display request of the window display and the display request from the pointing device are produced, the display request of the window display is met by said fourth means, and the display request from the pointing device is met by said second means;

g) a matrix electrode comprising scanning lines and information lines, with said matrix electrode being electrically connected to said image information memory and receiving image information therefrom; and h) drive means for driving said matrix electrode.

5. A display system according to claim 4, comprising liquid crystal between said scanning lines and said information lines.

6. A display system according to claim 5, wherein said liquid crystal is ferroelectric liquid crystal.

7. A display system according to claim 4, wherein the image information for the window display is for a moving image.

8. A display system according to claim 7, wherein the image information for the moving image is for a scrolling image display.

* * * * *

UNITED STATES PATENT AND TRADEMARK OFFICE

CERTIFICATE OF CORRECTION

PATENT NO. : 5,408,247

DATED : April 18, 1995

INVENTOR(S) : Enomoto et al.

It is certified that error appears in the above-indentified patent and that said Letters Patent is hereby corrected as shown below:

COLUMN 7:

Line 31, "DPYING" should read --DPYINT--.

COLUMN 10:

Line 56, "74ASL878" should read --74ALS878--.

COLUMN 12:

Line 17, "epxlained" should read --explained--.
Line 37, "molecule 144" should read --molecule 143--.

COLUMN 13:

Line 29, "graphic" should read --graphics--.

Signed and Sealed this

Seventh Day of November, 1995

*Attest:*

Bruce Lehman

BRUCE LEHMAN

*Attesting Officer*

*Commissioner of Patents and Trademarks*